US007611664B2

(12) United States Patent
Mizuno et al.

(10) Patent No.: US 7,611,664 B2
(45) Date of Patent: Nov. 3, 2009

(54) CONTAINER FOR SUPPLYING MOLTEN METAL AND SAFETY DEVICE

(75) Inventors: Hitoshi Mizuno, Toyota (JP); Kouji Iyoda, Toyota (JP); Tsuyoshi Abe, Toyota (JP); Narumi Ichikawa, Toyota (JP); Kazunori Suzuki, Toyota (JP); Kenji Noguchi, Toyota (JP)

(73) Assignee: Hoei Shokai Co., Ltd., Aichi (JP)

( * ) Notice: Subject to any disclaimer, the term of this patent is extended or adjusted under 35 U.S.C. 154(b) by 461 days.

(21) Appl. No.: 10/504,508

(22) PCT Filed: Feb. 13, 2003 (Under 37 CFR 1.47)

(86) PCT No.: PCT/JP03/01510

§ 371 (c)(1), (2), (4) Date: Jun. 15, 2005

(87) PCT Pub. No.: WO03/068433

PCT Pub. Date: Aug. 21, 2003

(65) Prior Publication Data

US 2006/0048913 A1 Mar. 9, 2006

(30) Foreign Application Priority Data

| | | |
|---|---|---|
| Feb. 14, 2002 | (JP) | 2002-037509 |
| Sep. 18, 2002 | (JP) | 2002-272331 |
| Dec. 6, 2002 | (JP) | 2002-383078 |
| Dec. 28, 2002 | (JP) | 2002-383795 |

(51) Int. Cl.
*B22D 41/00* (2006.01)
*B22D 41/50* (2006.01)

(52) U.S. Cl. ..... 266/236; 222/593; 222/595; 266/239; 266/271; 266/272; 266/275; 164/337; 220/562

(58) Field of Classification Search ..... 266/236, 266/239, 271–272, 275; 222/593, 595; 164/337; 220/562

See application file for complete search history.

(56) References Cited

U.S. PATENT DOCUMENTS

| | | | | |
|---|---|---|---|---|
| 3,441,261 | A * | 4/1969 | Sommer | 266/89 |
| 3,627,018 | A * | 12/1971 | Costello et al. | 164/113 |
| 4,877,219 | A * | 10/1989 | Yano | 251/149.2 |
| 5,271,539 | A * | 12/1993 | Ozawa et al. | 222/595 |
| 7,204,954 | B2 * | 4/2007 | Mizuno et al. | 266/239 |
| 2004/0089987 | A1 * | 5/2004 | Kodama et al. | 266/236 |

FOREIGN PATENT DOCUMENTS

| | | | |
|---|---|---|---|
| JP | 51-123725 | A | 10/1976 |
| JP | 02-052164 | * | 2/1990 |
| JP | 08-20826 | A | 1/1996 |
| JP | 2001-183214 | * | 7/2001 |
| JP | 2002-254159 | A | 9/2002 |
| JP | 2002-263828 | A | 9/2002 |
| JP | 2003-83682 | A | 3/2003 |

OTHER PUBLICATIONS

International Search Report mailed on May 27, 2003.

* cited by examiner

*Primary Examiner*—Roy King
*Assistant Examiner*—Lois Zheng
(74) *Attorney, Agent, or Firm*—Rader, Fishman & Grauer, PLLC

(57) ABSTRACT

A molten metal supplying container, comprising a container capable of storing a molten metal and loading the molten metal to the inside thereof or supplying the molten metal to the outside thereof by controlling a difference in pressure between inside and outside of the container, a passage allowing the inside and outside of the container to communicate with each other to have the molten metal flow therethrough, a lid disposed to cover the first opening having a second opening with a diameter smaller than the first opening and a hatch provided at the second opening capable of being opened and closed, having a passage communicating inside and outside the container. The passage is used, for example, to control inner pressure of the container and to insert the electrode for detecting the surface level of the molten metal.

8 Claims, 17 Drawing Sheets

CONTAINER FOR SUPPLYING MOLTEN METAL AND SAFETY DEVICE

FIELD OF THE INVENTION

The present invention relates to a molten metal supplying container that is used to supply a molten metal of such as an aluminum alloy or a magnesium alloy to a use-point such as a die-cast machine and a safety device that can be suitably used for the molten metal supplying container.

BACKGROUND OF THE INVENTION

In a factory where many die-cast machines are used to mold aluminum (including aluminum alloy, same as above), an aluminum material is frequently supplied not only from the inside of the factory but also from the outside of the factory. So far, the material has generally been supplied in the form of an ingot. Recently, transporting a container that accommodates molten aluminum from a factory of a material supplier side to a molding factory side and thereby to supply a material in a molten state to the respective die-cast machines has gradually become common.

A conventional container has a structure like a teapot in which a pourer for use in supply is attached on a sidewall of a container body where molten metal is stored. The molten metal is supplied from the pourer to a storing furnace on a molding side when such a container is inclined.

However, the conventional container is inclined by use of, for instance, a forklift. Such an operation cannot necessarily be safe. Furthermore, in order to largely incline (inclination and rotation operation) the container, the forklift has to be provided with a rotation mechanism. Accordingly, a structure of the forklift necessarily becomes a special. Still furthermore, there is a problem in that a skilled operator is necessary to carry out the inclination operation of the container.

In this connection, a system in which pressure is applied to the inside of a container to supply the molten metal to a storing furnace is proposed. When such a container utilizing a pressure difference is adopted, not only the safety and operability is improved but also more complicated supply service becomes available (JP-UM-A-03-31063 (FIG. 1)).

In the conventional container, the molten metal is introduced into inside of the container by opening a lid provided at an upper portion thereof and dropping the molten metal therefrom. To the contrary, the present inventors have proposed a system in which the inside of a hermetically sealed container is depressurized and a molten metal is externally introduced into the container. For instance, a molten metal is introduced from outside through a molten metal supplying pipe. When such a process is adopted, it is necessary to assuredly detect that the container became full at the time of introduction of the molten metal.

Furthermore, in the container having the abovementioned configuration, there is a problem in that a pipe for supplying a pressurized gas is likely to be clogged. In particular, according to the above-described system, a container is mounted on a truck and transported from one factory to another through a public road. Accordingly, in many cases, the container is wobbled. For this reason, as a liquid level of the molten metal in the container is wobbled, the molten metal is spattered in the container, and thereby adhere to the pipe for supplying pressurized gas. When, for instance, such an adhesion is repeated, the clogging of the pipe occurs.

Still furthermore, in the case that a container of this kind is being transported, the hole connecting the container to a pressurized gas supply port is necessary to be sealed in order that the molten metal would not leak therefrom. In the case of the hole being closed to hermetically seal the container, in some cases, the pressure inside the container is raised owing to the thermal expansion of a gas and so on. As a result, in some cases, a problem arises in that the molten metal is unexpectedly discharged from the pipe for discharging the molten metal. When the lining of the container is insufficiently dried, owing to vaporization of water, a pressure increase in the container becomes remarkable.

DISCLOSURE OF THE INVENTION

The main object of the present invention is to provide a container for supplying a molten metal with high reliability and certainty. In addition, the object of the present invention is to offer a container for supplying a molten metal which is capable of detecting that the container had become full without fail.

Another object of the present invention is to provide a molten metal supplying container capable of preventing the pipes and holes provided for adjusting inner pressure from clogging.

Another object of the present invention is to provide a container and a safety device that is capable of closing a passage so that the molten metal do not flows out in an emergency and, moreover, prevent a case where the molten metal flows out unexpectedly from the pipes.

In order to achieve the object of the present invention, a molten metal supplying container of main object of the present invention is comprised of a container capable of storing a molten metal and loading and supplying the molten metal to inside and to outside of the container having a first opening, a passage communicating inside and outside of the container and capable of having the molten metal flow therein, a lid disposed to cover the first opening having a second opening with a diameter smaller than the first opening and a hatch provided at the second opening capable of being opened and closed, having a passage communicating inside and outside the container.

A conventional "inclining" type container is not designed to be pressure resistant and the leaking of the air cannot be prevented. Therefore, supplying the molten metal using the pressure had been extremely difficult. On the other hand, the container of the present invention is capable of supplying the molten metal into and out of the container by controlling pressure difference between inside and outside the container, and, basically, the container is a "hermetically sealed" type having pressure resistant structure. For example, the molten aluminum alloy contained in the inside thereof can be supplied to the outside by an atmospheric pressure of 1 kPa to 50 kPa.

The passage provided at a hatch of the container of the present invention is used, for example, for adjusting inner pressure of the container (applying and reducing pressure). In addition, the passage is used to insert the electrode for detecting the surface level of the molten metal. Of course, the passage may be used for other purposes. For example, a relief valve may be connected to the passage. With this configuration, pressure inside the container can be decreased to a safe level and/or may be released to atmosphere when the pressure inside the container became more than a predetermined value. Therefore, the safety level increases. Being safe is important because when inside the container becomes more than the predetermined value while the container being hermetically sealed, there is a risk of the molten metal unexpectedly flowing out of the pipe and the like.

According to the present invention, a passage for releasing pressure is provided in the hatch. For this reason, every time when the hatch is being opened and closed, the condition of the passage can be checked from the rear side of the hatch (i.e. from inside the container). For example, a state where the passage is about to be clogged or has been clogged with the metal being attached thereto can be checked, therefore can be taken care of.

(1) A molten metal supplying container of one embodiment of the present invention is comprised of a container capable of storing a molten metal and loading and supplying the molten metal to inside and to outside of the container having a first opening, a passage communicating inside and outside of the container and capable of having the molten metal flow therein, a lid disposed to cover the first opening having a second opening with a diameter smaller than the first opening, a first socket or a plug disposed at the first passage to form a first coupler, a second plug or a socket disposed at the second passage to form a second coupler.

Here, the plug comprises the coupler formed from at least one pair of "the plug and the socket" means "the plug" of the "the plug and the socket". For example, the plug can be disposed in the passage and can be hermetically connected with the socket. Of course, the socket can also be disposed at the passage.

According to the present invention, for example, a first plug is connected to a first socket to which a first electrode is penetrated through and a second plug is connected to a second socket to which a second electrode is penetrated through. Top ends of the both electrodes are disposed at, at a predetermined level, for example, a surface level when the container is full with the molten metal. Whether the container is fully loaded with the molten metal can be detected by detecting the flow of electricity between the electrodes. In addition, a plurality of surface levels may be detected by using a plurality of electrodes with different lengths.

In addition, normally, the container is preheated using a heating device such as a gas burner prior to supplying the molten metal therein. The pre-heating is carried out as the hatch being opened and a part of the heating device being inserted into the container. Therefore, the hatch is opened every time when the molten metal is being supplied inside the container and every time when the container is pre-heated. The hatch is structured such that it does not have to be opened every time but can be opened easily when necessary.

According to the present invention, since a first and a second passage are provided in the hatch of such kind that the plug or the socket may be detachably provided, adhesion of the metal to the first and the second passage can be checked every time the molten metal is supplied into the container. Especially, the electrode that is inserted through the socket attached to the plug is disposed not so apart from the inner periphery of the passage, and when the metal is placed therebetween the electronic short-circuit occur. Therefore, the adhesion of the metal against the passage can be checked, the metal is being peeled off every time it attached to the passage so that the insulation between the electrode and the hatch can be formed, leading to the prevention of the short-circuit caused by the adhesion of metal. With such configuration of the present invention, "the container had become full" can be detected without fail. In the present invention, since the electrode is inserted into the container using a coupler structure, the electrode can easily be attached and detached.

In addition, the second opening of the molten metal supplying container of the present invention is best suited to be provided approximately at the center of the lid, in other words, the hatch should approximately be provided at the center of the top surface portion of the container.

This is because, in a case where the surface of liquid tilts and being splashed as the container being wobbled, the comparative change in the surface level of the liquid and degree that the liquid being splashed is smaller at the point closer to the center portion than at the point close to the outer periphery. The hatch having a passage as mentioned above is provided approximately at the center of the top surface portion of the container where the change in the level of the liquid and the degree that the liquid being splashed is small. With this configuration, chances that the metal being attached to the passage is small, in fact, the metal does not attach thereto. Therefore, according to the present invention the short circuit caused by adhesion of the metal can be prevented. Thus, according to the present invention, the liquid surface level of the molten metal loaded inside the container had reached a predetermined level (i.e. "the container had become full", for example) can be detected without fail. Therefore, the safety level increases.

A molten metal supplying container of one embodiment of the present invention is comprised of a container capable of storing a molten metal and loading and supplying the molten metal to inside and to outside of the container having a first opening, a passage communicating inside and outside of the container and capable of having the molten metal flow therein, a lid disposed to cover the first opening having a second opening with a diameter smaller than the first opening, a plug disposed at the passage to form a coupler, a means for grounding the molten metal stored inside the container.

According to the present invention, the number of passages and the couplers can be decreased. Therefore the possibility of short-circuit may be decreased even further. For this reason, the reliability of detecting the "container being fully loaded with the molten metal" can be increased.

The molten metal supplying container of the present invention may be applied to a system of loading a molten metal into the container from outside by decreasing pressure inside the container, through a flow path formed by a pipe with a lining and the like. In such case, it is preferable for the system to be comprised of, means for decreasing pressure inside the container, means for weighing the molten metal supplying container, means for detecting a short-circuit between the first electrode and the second electrode or between the third electrode and the grounding, means for retrieving the reduced pressure state inside the container to the atmospheric level when the measured weight exceeds a predetermined value or when the short-circuit is detected.

Here, "when the measured weight becomes more than a predetermined value" or "when a short circuit is detected" indicates one of the two conditions. When one of these conditions is met, the container is assumed to become full and operation of decreasing the pressure is stopped and the pressure is returned to atmospheric pressure. As the judgment to whether the container becoming full is carried out by two conditions as described, even when one of the two judgments failed and/or being erroneous, the container being fully loaded can be detected without fail.

Moreover, the structure such as in this system, may be provided to a transporting vehicle loaded with the molten metal supplying container and transports the container.

In this case, a pair of channel member, to which a fork (a holding member) of a fork lift is inserted and withdrawn, may be attached to the bottom portion of the molten metal supplying container, and the fork lift can be used as a transporting vehicle. Then the molten metal supplying container may be weighed by a pressure sensor provided on the surface of the fork, an oil pressure measuring means in an oil-pressure type moving mechanism for causing the vertical movement of the fork and a load-cell detecting the rotating moment of the fork.

Further, according to one embodiment of a molten metal supplying container of the present invention comprises, a container capable of storing a molten metal and loading and supplying the molten metal to inside and to outside of the container having a first opening, a passage communicating inside and outside of the container and capable of having the molten metal flow therein, a lid disposed to cover the first opening having a second opening with a diameter smaller than the first opening and a hatch provided at the second opening capable of being opened and closed, having at least one passage capable of being inserted with an electrode for detecting the surface level of the molten metal.

Further, a molten metal supplying container of the present invention comprises, a container capable of storing a molten metal and loading and supplying the molten metal to inside and to outside of the container having a first opening, a passage communicating inside and outside of the container and capable of having the molten metal flow therein, a lid disposed to cover the first opening having a second opening with a diameter smaller than the first opening and a hatch provided at a top surface portion of the lid, capable of being opened and closed, having at least a first passage communicating inside and outside of the container and at least one second passage capable of being inserted with an electrode for detecting the surface level of the molten metal. The first passage and the second passage may be provided in plurality. In addition, an insulating member that insulates the hatch and the electrode when the electrode is inserted into the passage may be provided further.

In addition, the molten metal supplying container of the present invention has a characteristic in that electrode for detecting the surface level of the molten metal is set by an interface that is detachably provided. Further, when the electrode is not inserted into the passage a cap capable of hermetically sealing the passage and compatible with the electrode is set to the passage by the interface.

For example, when the molten metal is sucked as having the pressure inside the container negative, the electrode is inserted through the passage, and the surface level of the molten metal inside the container is detected. On the other hand, in a case other than the one described (for example, the inside the container is pressurized to have the molten metal contained therein pushed out), the passage is necessary to be hermetically sealed in order that the predetermined amount of pressure can be applied. An interface to realize such hermetical sealant may be achieved with a structure of a coupler comprised of a plug and a socket. For example, the plug may be fixed to the passage and the socket may be used as a cap to realize the hermetically sealed connection as being connected with the plug. On the other hand, when a socket of an electrode is provided with an insulating member is provided to the electrode and the cap sharing the common interface can be realized. By adopting such structure, the molten metal supplying container of the present invention operability thereof may be increased. For example, an operation having a multiple steps such as the molten metal being supplied to the inside of the container and, after that, being pushed out of the container at a use-point, can be executed easily, and in the same time, assuredly.

Normally, rubber made packing is used as a gasket for a hermetic sealing portion used for the cap described above (for example, Viton™ NBR, EPR, Perflow). However, washers of such kind have a problem of being deteriorated as they are exposed to the heat with high temperature at a time of pre-heating and the like. When the washer is damaged, problem arises in that a sufficient hermetical environment may not be achieved, as a result, inside of the container cannot be pressurized hard enough to a level necessary for supplying the molten metal or decrease the pressure therein. For example, the heat resistant type member such as "Viton"™ may be applied, however, its temperature limit is approximately 180 degrees Celsius, insufficient for a structure of the molten metal supplying container. According to the container of the present invention, a second passage for inserting an electrode is provided at the hatch. Since the hatch being opened at a time of pre-heating, the seal portion is protected from the heat when pre-heating the container.

In addition, according to another object of the present invention, the molten metal supplying container comprises from a frame, a lining disposed inside the flow path for having the molten metal flow to the inside/outside the container, a metal pipe disposed being buried into the lining to surround the passage and, on the inner surface thereof, an oxidized material is being formed.

In other words, this container is capable of using the pipe provided for forming the flow path in a form of being buried in the lining, as at least one of the pair of electrodes provided for detecting the conduction state. In other words, according to the present invention, the conduction or short-circuit can be detected.

It is preferable for the electrode to be situated at a lower portion, even when a wide range of liquid level is to be detected. However, the electrode is damaged quickly caused by heat and/or chemical reaction when the electrode is immersed into a molten aluminum and the like, and does not function anymore. According to the present invention, the pipe placed inside the lining formed of refractory material or insulating material is used as an electrode. By adopting such structure, the electrode can be protected from the effect caused by heat at a time of pre-heating and effect caused by oxidation. Also, since the electrode is not immersed into the molten metal directly, the duration of the electrode can be improved and the reliability and safety of the molten metal supplying container can also be improved.

Further, in such case that the metal pipe is buried in a position that cannot be accessed from outside, a conduction body connected to the first pipe may be brought to the outside. In this case, space between the frame and the conductive body may also be insulated in a way described above.

In addition, the molten metal supplying system of the present invention comprises a detector for detecting conduction between the container for supplying the molten metal of the present invention and at least one of the pipe and the electrode, a pressure controlling portion for controlling a pressure inside the container through the passage according to the detected conduction condition.

In other words, the molten metal supplying system of the present invention detects the conduction between each of the electrode in the above-described container and controls the applying, reducing and retrieving (i.e. releasing to the atmosphere) the pressure applied to the container according the detected result. For example, as described above, the overflow of the molten metal when supplying thereof to the container can be prevented.

(2) A system of supplying a molten metal according to the present invention comprises, a container capable of loading a molten metal therein and supplying thereof to the outside by controlling the pressure difference between the inside and the outside of the container, a passage communicating inside and outside of the container capable of having the molten metal flow therein and a hatch provided at the upper surface portion of the container disposed to be capable of being opened and closed having a passage for controlling pressure inside the container as it communicates inside and outside of the container.

Normally, the container is preheated using a heating device such as a gas burner prior to supplying the molten metal therein. The preheating is carried out as the hatch being opened and a part of the heating device being inserted into the container. Therefore, the hatch is opened every time when the molten metal is being supplied inside the container and every time when the container is preheated. According to the present invention, since a passage for adjusting inner pressure is provided in the hatch, adhesion of metal to the passage for adjusting inner pressure can be checked every time the molten metal is loaded into the container. Then the metal can be peeled off each time the molten metal is loaded to the container. This makes it possible to prevent clogging of the pipe and the passage used for adjusting the inner pressure. In addition, according to the present invention, the hatch is provided with a sealing member to hermetically seal inside the container such as stuffing. The stuffing is preferably made from heat resistant material such as silicon.

The molten metal supplying container of the present invention is characterized by the hatch being provided at approximately center of a top surface portion of the container.

This is because, in a case where the surface of liquid tilts and being splashed as the container being wobbled, degree that the liquid being splashed is smaller at the point closer to the center portion than at the point close to the outer periphery. According to the present invention, the hatch is provided with a passage for adjusting the inner pressure and the hatch is provided at an approximately center of the top surface portion of the container where the degree that the surface of the liquid changes and the liquid being splashed is small, as described above. For this reason, the metal is less likely to be attached to the pipe and/or the hole provided for adjusting the inner pressure. This makes it possible to prevent clogging of the pipe and/or the passage used for adjusting the inner pressure.

A molten metal supplying container of the present invention further comprises, a pipe disposed in the passage and extends to an upper direction from an upper portion of the container and bends and extends to a horizontal direction at a predetermined height.

A system where the container of the present invention is used, for example, a pipe extended from a tank for compressed gas and a pump for reducing pressure is connected to, for example, the passage. Such connection is carried out every time when the molten metal is loaded into the container or when the molten metal is supplied to an outside from inside of the container. On the other hand, the container storing the molten metal has extremely high temperature, thus operability thereof is poor. The container according to the present invention is structured such that the passage for adjusting the inner pressure is provided approximately at the center of the top surface of the container. Therefore the operability of connecting pipes is extremely poor when a pipe that extends to the right above the passage is connected. For example, when a molten metal with a temperature of 700 degrees Celsius is loaded into the container, the temperature outside the container could become 200 degrees Celsius. The operability of connecting pipes performed as an operator bending over the lid has a low operability. To the contrary, since the pipe is structured such that it is extended to a horizontal direction as described above, for example, the operator may stretch his/her hands to the connecting point and the operation can be carried out safely.

According to the molten metal supplying container of the present invention, the pipe is detachably screwed into the passage.

With such structure, the pipe being extended to the horizontal direction itself may be used as a spanner and the pipe may be attached/detached from the passage. Therefore, attaching and detaching of the pipe can be done easily without using a special tool and the like. With this configuration, for example, the clogging of the pipe can be checked often, therefore, the clogging of the pipe used for adjusting inner pressure may be prevented.

As a molten metal supplying container described above, the container body and a pipe disposed outside the container body from a position shifted from the center of the container body.

When the pipe being left immersed into the molten content, the pipes clogs immediately. To the contrary, according to the present invention, the pipe is disposed to a position shifted from the center of the container body, therefore, the change in the surface level of the liquid becomes large when being tilted and the molten content of the container being supplied at this position. When the container is brought back to its original horizontal position, a space is formed between the bottom end of the pipe and the surface of the molten content, thus the clogging of the pipe can be prevented.

The container of the present invention comprises from a container body, a pipe being connected to around a bottom portion of the container body and tilting at least upwards.

The container of the present invention comprises from a container body, a separation wall separating inside the container into a plurality of spaces at around the bottom portion and a gutter portion connected to one side of the separated space.

In other words, when the pipe is located inside the main body of the container, problems such as "clumsy maintenance operation", "clogging" and "the pipe being damaged at the time of maintenance" occurs.

According to the present invention, one of the plurality of spaces separated by the separation wall is used instead of the pipe. For example, having the molten metal over flow from the opening portion and supplied using the gutter. With such configuration, the maintenance operation becomes very simple, the pipe is unlikely to clog and even it clogs, it can be recovered by the maintenance operation.

(3) According to the main object of the present invention, a restriction member disposed inside the second flow path connected to the passage and having a gas pass therethrough and, in the same time, restricts the molten metal to pass therethrough is provided.

Another object of the present invention is a safety device of a container capable of loading a molten metal therein and supplying thereof to the outside by controlling the pressure difference between the inside and the outside of the container, being disposed at an upper portion of the container and having a passage capable of releasing pressure inside the container and a restricting member provided in the passage so as to restrict a flow of the molten metal inside the passage.

Here, the restriction member is most preferably provided such that, when the molten metal flows therein, removes the heat to increase the viscosity thereof or solidifies the molten metal.

According to the present invention, a restriction member disposed inside the second flow path connected to the passage and having a gas pass therethrough is provided. With this configuration, the passage can be covered so that the molten metal does not leaks out and in the same time the case where the molten metal unexpectedly flowing out from the pipe can be prevented. In other words, even in a case where pressure inside the container had been increased, caused by expansion of gas and evaporation of moisture and the like the pressure can be released to the outside by the cap provided with a flow path for having molten metal flow, a pipe for releasing pressure, restriction member and/or a cap. Therefore, the molten metal being unexpectedly leaking outside can be prevented. On the other hand, the molten metal cannot be prevented from leaking out from the opening provided with the restriction member. This is because a restriction member such as an sintered metal and products such as a ceramic fiber and the like allow a gas to pass through, however, can be a sufficiently big enough resistant against the molten metal such as molten aluminum alloy. In addition, in a case of a fine pores and a orifice, the molten metal is deprived of the heat as it passes through these holes and solidifies, and the solidified metal itself prevents further flowing of the molten metal itself. A restriction member and/or a safety device are preferable to be large in calorie capacity and surface area. This is because when the molten metal flows through the safety device, the larger the heating capacity of the metal, more likely that viscosity a rise or solidifies caused by cooling thereof. This is because larger the surface area thereof more likely that the heat received by the restriction member disperses to the outside.

Here, as a restriction member to be provided to the cap, for example, a material that allows a gas to pass therethrough but not the molten aluminum, such as steel wool, steel scrubber, a molded ceramic fiber, a molded sintered metal, a porous ceramics, a member provided with a micro passage, an orifice can be named. The steel wool, the steel scrubber, the ceramic fiber are less expensive compared with the sintered metal and the ceramics and the like. In addition, the sintered metal and the ceramics are to be fixed to the cap, therefore, changing thereof cannot be done easily. On the other hand, the steel wool and the ceramic fiber may be replaced quite easily, therefore, maintenance operation can be performed with ease. The restriction member is not limited to the materials mentioned above, so long as the aim of the present invention can be achieved. In any case, the restriction member as set forth in the present invention has small enough resistant against the gas such as the air and water vapor, however, has large enough resistant against the molten metals such as aluminum alloy.

Here, a cap detachably disposed by the interface having a restriction member may also be provided. Then, it is preferable to be further comprised with a socket or a plug of a coupler formed with a pair of the socket and the plug. And an interface of the cap is capable of forming a coupler with said plug or the socket with its own socket or own plug. With this configuration, the attachment and detachment of the cap becomes easy thus the workability increases.

The present invention may be structured such that a pipe disposed in the passage and extends to an upper direction from an upper portion of the container and bends and extends to a horizontal direction at a predetermined height and a plug or a socket is disposed at a top end of the pipe. The pipe comprises of a coupler formed with a pair of a socket and a plug and an interface of the cap may be structured to have one of the other socket or the plug of said coupler.

This enables an operator to attach/detach the cap, preventing a case such that he/she touching the heated container. In such case, the pipe may be structured to have a flexible joint portion such as "swivel joint" and the restriction member may be inserted between the flexible joint portion and the passage. With this configuration, the pipe can easily be rotated by an operator thus the cap can be attachment and detachment operation of the pipe can be carried out smoothly as bringing the connecting portion to a desired position. The "swivel joint" is a joint capable of rotating. The present invention is especially effective when the container is rotated and would like to have the connected piping and the like rotate simultaneously. This swivel joint has a certain size due to the structure thereof and the heat capacity is larger than a simple pipe. For this reason, the swivel joint can also functions as a restriction member of the molten metal described above.

A molten metal supplying container according to another object of the present invention comprises, a container capable of storing a molten metal and having a passage communicating inside and outside of the container, a first flow path communicating the inside and the outside of the container communicating the inside and the outside of the container, capable of having the molten metal flow therein, a restricting member detachably disposed at the opening portion of the first flow path, which allows the passage of the gas but restricts the passage of the molten metal.

In other words, the molten metal supplying container of the present invention has an above-described safety device of the present invention and restriction member or a cap is detachably provided at the opening portion outside of the first flow path of the container where the molten metal flows. For example, a pipe for having the molten metal flow may be provided to a container and the restriction member may be provided at an opening portion of the pipe. In order to have the restriction member detachable, the restriction member may be pushed into an opening portion by a jig, such as toggle type clamping to make it a cap. With this configuration, even the pressure inside the container arises suddenly in the middle of transportation by the truck and the like, the molten metal can be prevented from leaking. In addition, the safety device is removed when the molten metal is supplied to the use point.

BEST MODE FOR CARRYING OUT THE INVENTION

Hereinafter, embodiments of the present invention will be described with reference to the drawings.

Figure 1:
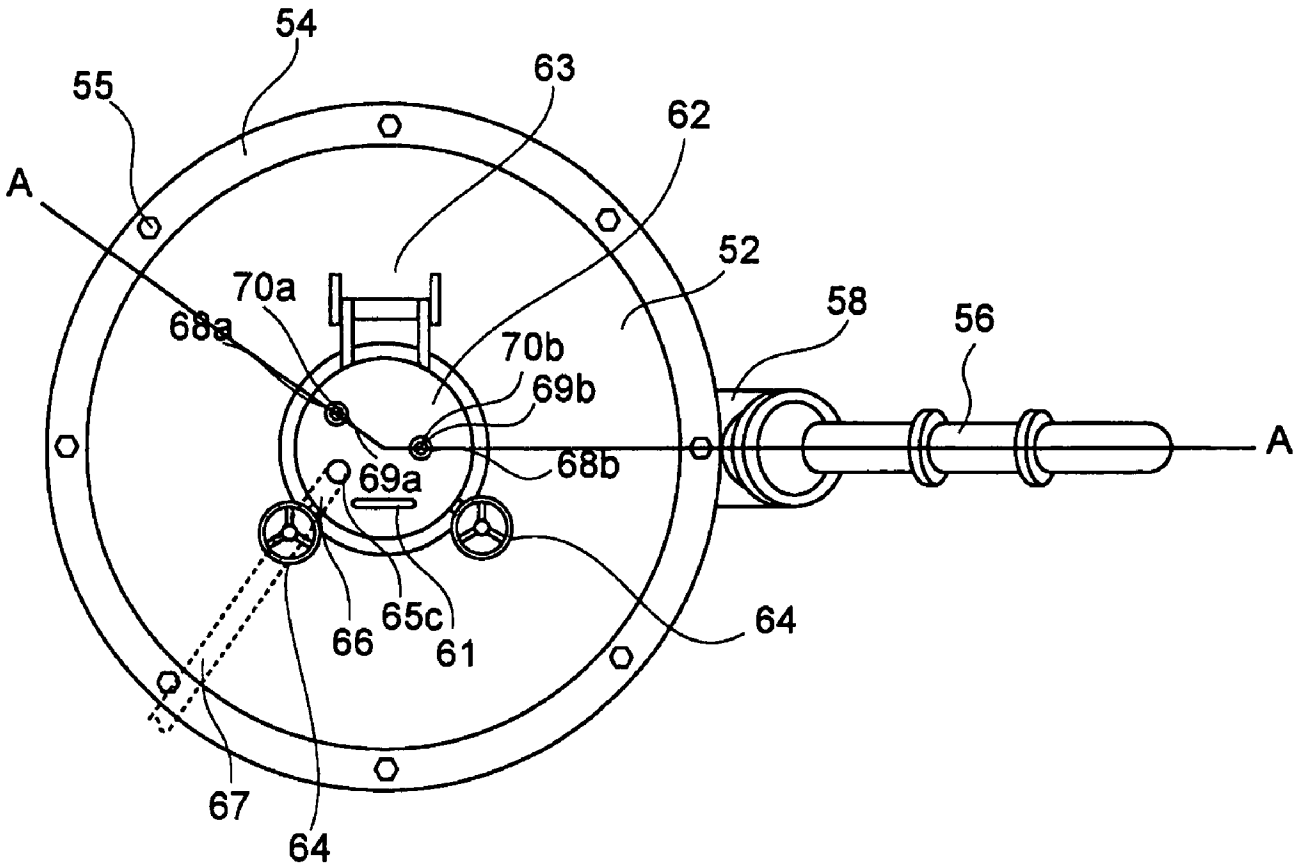
FIG. 1 is a plan view showing a configuration of a molten metal supplying container relating to one embodiment of the present invention.
Figure 2:
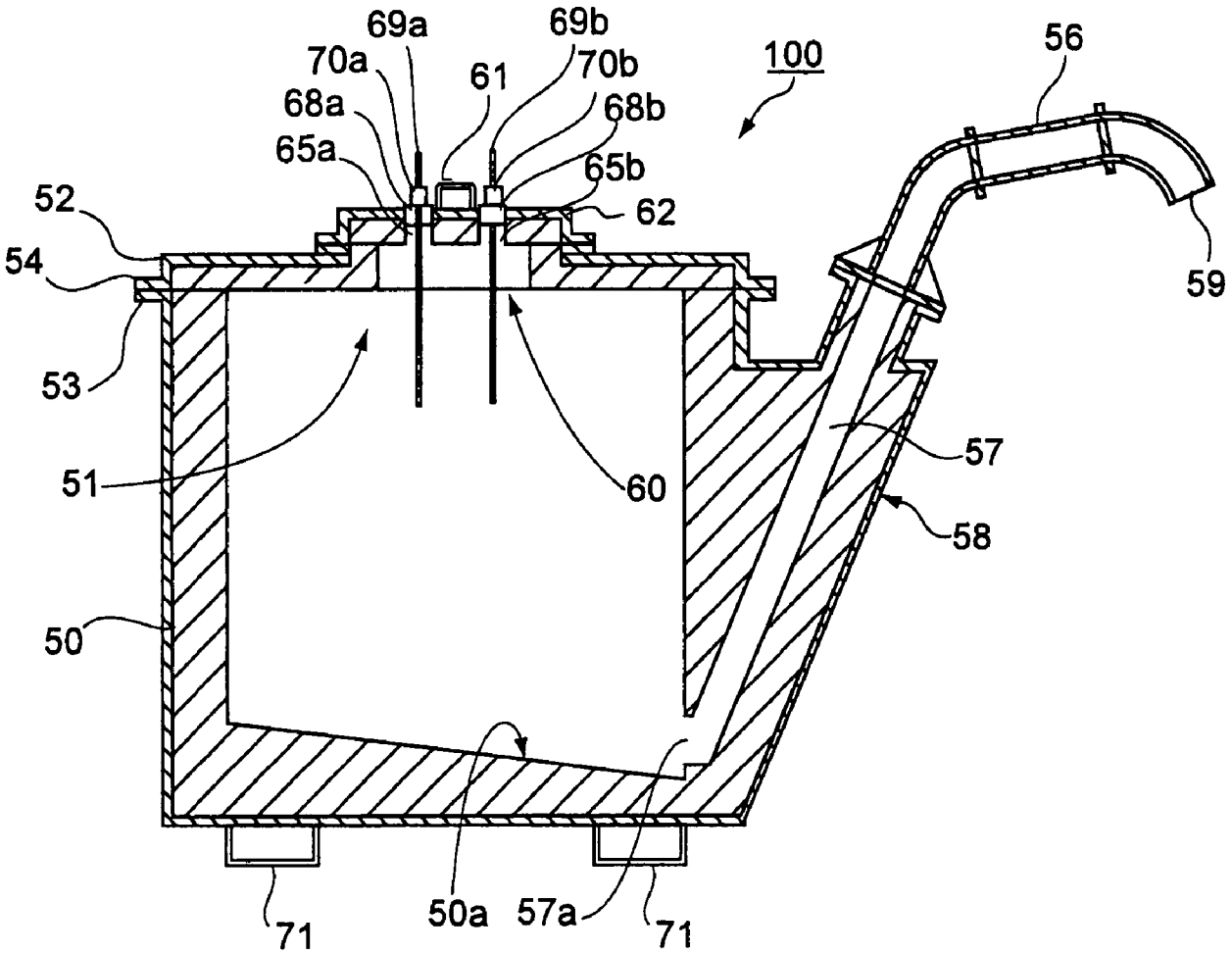
FIG. 2 is an A-A cross-sectional view in FIG. 1.

FIG. 1 is a plan view showing a configuration of a molten metal supplying container used in such a system and FIG. 2 is an A-A cross-sectional view of FIG. 1.

The molten metal supplying container 100 is configured such that a large lid 52 is provided at an upper opening 51 of a bottomed cylindrical body 50. External peripheries of the body 50 and the large lid 52, respectively, are provided with flanges 53 and 54. The flanges are fastened with bolts 55 to fix the body 50 and the large lid 52. For instance, the outside of the body 50 and the large lid 52 (i.e. frame) is made of a metal (such as iron). The inside of the frame is made of refractories, with a heat insulator being inserted between the metal frame and the refractory material.

At one point on the outer periphery of the body 50, a pipe attachment portion 58 is provided which is provided with a flow path 57 starting from the inside of the body 50 and communicating with the pipe 56.

The flow path 57 in the pipe attachment portion 58 extends toward an upper portion on the outer periphery of the body 50, through an opening 57*a* provided at a position on the inner periphery of the body 50 close to a bottom portion 50*a* of the container body. The pipe 56 is fixed to communicate with the flow path 57 in the pipe attachment portion 58.

The pipe 56 has, for instance, aΓ (gamma)-like shape. A frame of the pipe 56 is made of a metal such as iron, and inside thereof a lining is formed. The lining is formed of a refractory member. The inside of the lining is formed as a flow path 72 of a molten metal. As a refractory member a fire resistant type ceramic material can be named as an example.

In addition, around the pipe 56 close to the pipe attachment portion 58, a heat insulator is disposed to surround the pipe 56. With this configuration, the pipe 56 side absorbs heat in the flow path 57 side and the decrease in temperature on the flow path 57 side can be prevented as much as possible. In particular, the surrounding area of the pipe 56 close to the pipe attachment portion 58 is a position where the molten metal is likely to be cooled and a liquid level wobbles when the container is transported. Accordingly, when the surrounding area of the pipe 56 close to the pipe attachment portion 58 is thus surrounded with the heat insulating member, the molten metal there can be prevented from solidifying.

The flow path 57 and the pipe 56 linking thereto are preferably almost the same in inner diameter, about 65 mm to about 85 mm. Conventionally, the inner diameters of those types of pipes are approximately 50 mm. This is because it was thought that when the inner diameters of those pipes exceed 50 mm, a large pressure is required to apply pressure to the inside of the container and discharge molten metal from them. However, the inventors of the present invention found that the inner diameters of the flow path 57 and the pipe 56 directly connected thereto are preferably in the range from approximately 65 mm to 85 mm, which is much larger than 50 mm and that they are more preferably in the range from approximately 70 mm to 80 mm, and that they are further more preferably 70 mm, the inner diameter of the pipe 56 is preferably 80 mm.

In other words, two parameters, weight of the molten metal in the pipe itself and viscosity resistance of the inside wall of the pipe and the flow path are considered to have a great effect on the resistance that prevents the molten metal from flowing inside the flow path and the pipe to the upper direction. That is, it is considered that the molten metal flowing through the flow path 57, is largely affected by weight of the molten metal itself present and the viscous resistance of the inner walls at any positions. However, the inventors found that when the inner diameter exceeds 65 mm, a region where the viscous resistance of the inner wall hardly affects starts to be generated from a around an approximately the center of a flow, and the region gradually becomes larger. The area has a large influence and, as a result, the resistance that obstructs the flow of the molten metal starts to fall. Thus, it becomes that only a very small pressure is needed to discharge the molten metal from the container. In other words, conventionally, the influence of such an area was not considered at all, and only the weight of the molten metal is considered as a cause of varying resistance that obstructs the flow of the molten metal. Due to the operability, maintenability, and so forth, the inner diameters was designated approximately 50 mm. On the other hand, when the inner diameters exceed 85 mm, the weight of the molten metal becomes dominant as a resistance that obstructs the flow of the molten metal. As a result, the resistance that obstructs the flow of the molten metal becomes large. According to the prototype produced by the inventors of the present invention and the like, when inside diameter being 65 mm to 80 mm, a very small pressure is sufficient to be applied to inside the container from the viewpoint of both the standardization and the operability. This is because the diameter of a pipe is standardized by 10 mm, namely, 50 mm, 60 mm, 70 mm etc and smaller the diameter, the easier to handle and the better the operability.

At almost the center of the aforementioned large lid 52, an opening 60 is provided, and a hatch 62 with a handle 61 attached thereto is disposed at the opening 60. The hatch 62 is provided at a position slightly higher than the upper face of the large lid 52. A portion on the outer periphery of the hatch 62 is attached to the large lid 52 through a hinge 63. This allows the hatch 62 to freely open and close the opening 60 in the large lid 52. In addition, bolts with handles 64 for fixing the hatch 62 to the large lid 52 are attached to two points of the outer periphery of the hatch 62 in a manner opposite to the position to which the hinge 63 is attached. By closing the opening 60 in the large lid 52 with the hatch 62 and rotating the bolts with handles 64, the hatch 62 is fixed to the large lid 52. On the other hand, by inversely rotating the bolts with handles 64 to release the fixation, the hatch 62 can be opened from the opening 60 in the large lid 52. Then, with the hatch 62 opened, maintenance of the inside of the container 100 and insertion of a gas burner at the time of preheating can be performed through the opening 60.

Passages 65*a*, 65*b*, 65*c* are provided at a position slightly off from the center of the hatch 62 by a predetermined distance. The first passage 65*a* is disposed on a side of the pipe 56, and the second and third passages 65*b* and 65*c* are disposed on a side opposite to the first passage 65*a*. Thereby, distances from the first passage 65*a* to the second and third passages 65 band 65*c* are made larger than a distance between the second passage 65*b* and the third passage 65*c*.

Each of the passages 65*a*, 65*b* and 65*c* is provided with a screw thread. To the first and second passages 65*a* and 65*b*, plugs 68*a* and 68*b* that constitute one of a coupler are attached. To the first passage 65*a*, a first socket 70*a* through which a first electrode 69*a* is inserted is attached. To the second passage 65*b*, a second socket 70*b* through which a second electrode 69*b* is inserted is attached. Each plug and socket forms a coupler.

Figure 3:
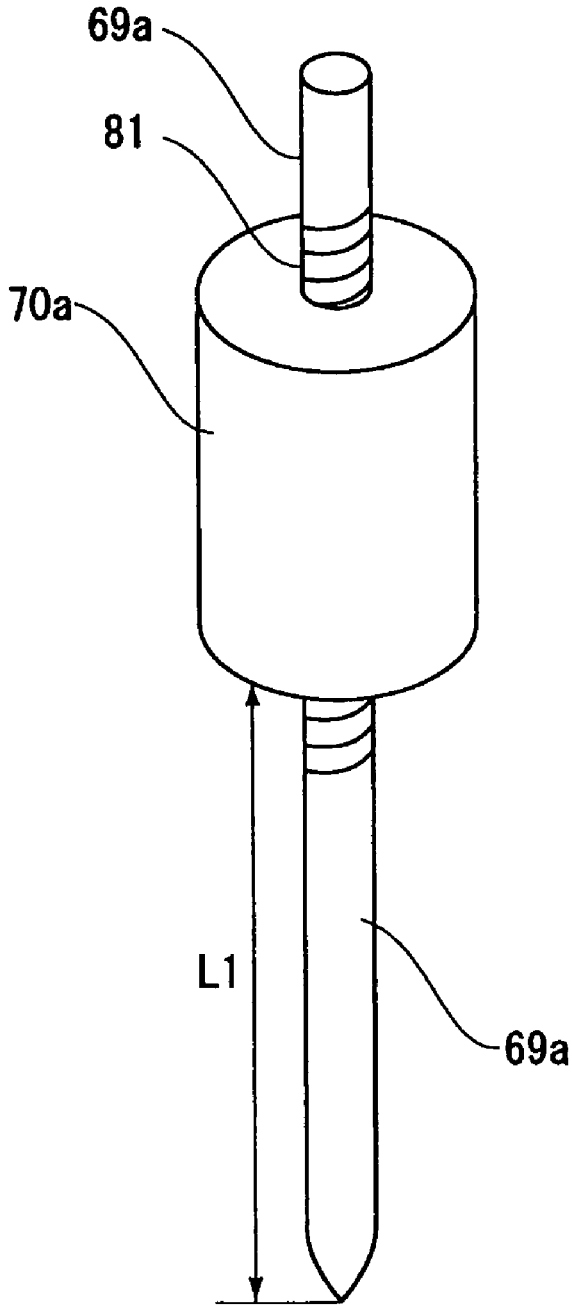
FIG. 3 is a diagram showing an electrode device that is constituted by inserting an electrode into a socket of the present invention.

FIG. 3 is a diagram showing an electrode device that is constituted by inserting an electrode into a socket of the present invention.

As shown in FIG. 3, in this device, an insulating tape 81 is wound at a position where the first electrode 69*a* is inserted into the first socket 70*a*. The first electrode 69*a* is inserted into the first socket 70*a*. The second electrode 69*b* is also similar in the situation. Lengths L1 in the container 100 of thus inserted two electrodes 69*a* and 69*b* are set at a length where top ends thereof may come into contact with a liquid level at a position where the molten metal in the container 100 is full.

Figure 4:
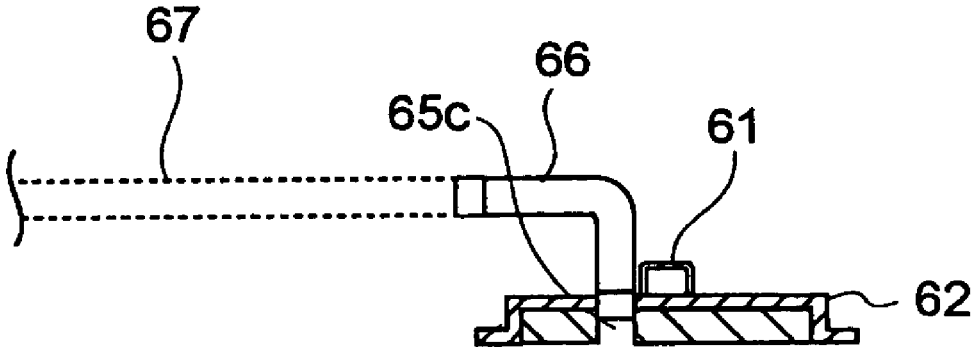
FIG. 4 is an explanatory diagram of a passage for controlling an inner pressure of a container of the present invention.

The third passage 65*c* is used to reduce or increase pressure inside of the container 100, and thereby inner pressure is controlled. To a third passage 65*c*, a pipe 66 for applying and reducing the pressure is connected as shown in FIG. 4. The pipe 66 extends upward from the third passage 65*c*, bends at a predetermined height, and extends in the horizontal direction. On a surface of a portion that is inserted into the passage 65*c* of the pipe 66, a screw thread is cut, and the passage 65*c* is also provided with a screw thread. Thereby, the pipe 66 is screwed to the passage 65*c* to fix.

To one end of the pipe 66, a flexible air-hose 67 for applying and reducing a pressure is connectable through a coupler structure (for instance, a plug at a top end of the pipe 66 and a socket at a top end of the air-hose 67). Then, by making use of pressure difference owing to the depressurization, the molten aluminum can be introduced into the container 100 through the pipe 56 and the flow path 57. Furthermore, when pressure is increased, by making use of Pressure difference, molten aluminum can be supplied outside of the container 100 through the flow path 57 and the pipe 56.

In the present embodiment, the hatch 62 that is disposed at an approximately center portion of the large lid 52 is provided with a passages 65*c* for controlling the pressure. On the other hand, since the pipe 66 extends in a horizontal direction, the pipe 67 for increasing or reducing pressure can be safely and conveniently connected to the pipe 66. Furthermore, since the pipe 66 thus extends, the pipe 66 can be rotated relative to the passage 65*c* with a small force. Furthermore, so that the pipe 66 screwed to the passage 65 can be fixed and removed by a very small force, for example, without using a tool.

On the rear face of the bottom portion of the body 50, two channels 71 as a foot portions having a cross section in a square shape into which, for example, a fork of the fork lift truck (not shown) is inserted and a predetermined length, are disposed, for example, in parallel to each other. The channel members 71 are disposed at an angle of, for instance, 45° to a direction in which the pipe 56 extends.

Further, the entire bottom portion 50*a* inside the body 50 is inclined to be low on the flow path 57 side. This reduces so-called remained melt when the molten aluminum is supplied to the outside through the flow path 57 and the pipe 56 by compression. In addition, when the container 100 is tilted, for example, at the time of maintenance to pour the molten aluminum to the outside through the flow path 57 and the pipe 56, the angle of tilting the container 100 can be decreased, providing improved safety and workability. However, such an inclination can be reversed, and thereby the opening 57*a* can be prevented from clogging.

In the container 100 according to the embodiment, the hatch 62 is provided with the first and second passages 65*a* and 65*b* through which an electrode for detecting whether the container is full or not is inserted. Accordingly, every time when the hatch 62 is opened, adhesion of the metal to the first and second passages 65*a* and 65*b* can be checked. Accordingly, short-circuit failure of the electrode can be eliminated. Furthermore, in the container 100 according to the embodiment, since, owing to the coupler structure, the electrodes 69*a* and 69*b* are inserted into the container 100, the electrodes 69*a* and 69*b* can easily be detached. Accordingly, for instance, during a time other than a time during which an operation of introducing molten aluminum into the container 100 is carried out, the electrodes 69*a* and 69*b* can be detached from the container 100. As a result, the electrodes 69*a* and 69*b* can be prevented from corroding and a liquid level can be accurately detected. In addition, when the electrodes 69*a* and 69*b* are detached from the container 100, sockets of which hole is clogged (not shown in the drawing) may be attached to the plugs 68*a* and 68*b*.

In the next place, a system configuration for introducing a molten metal into the container 100 will be explained with reference to FIG. 5.

Figure 5:
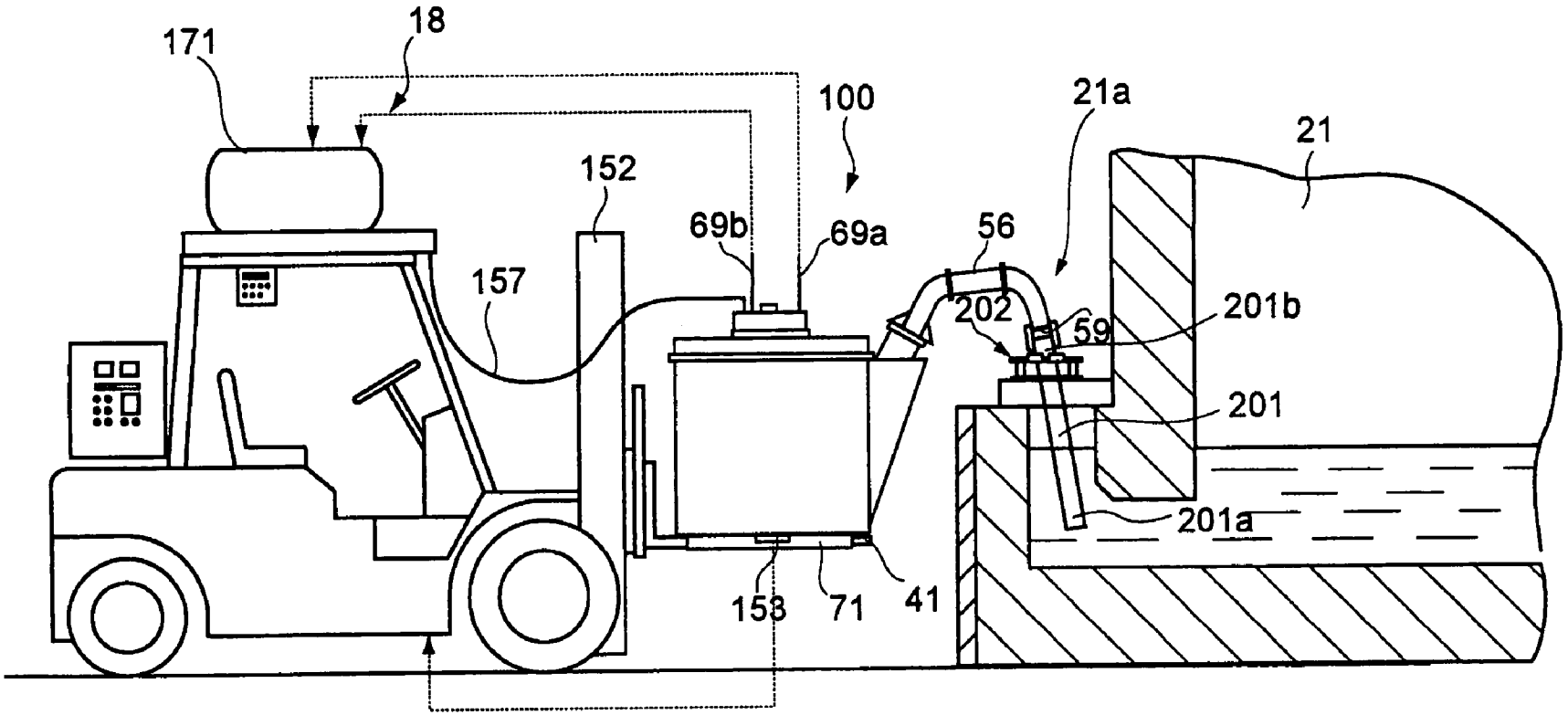
FIG. 5 is a diagram showing a configuration of a molten metal introduction system of the present invention.

As shown in FIG. 5, a forklift 18 holds the container 100 when forks 41 are engaged with the channel member 71 of the container 100. The forklift 18 has the forks 41 and a lifting mechanism 152 that lifts the forks 41 and thereby lifts up the container 100. Furthermore, a pressure sensor 153 is disposed on a surface of the fork 41.

Still furthermore, at an upper portion of a driving seat of the forklift 18, a receiver tank (not shown) for supplying a pressurizing gas, for instance, a highly pressurized air to the container 100 and a vacuum pump 171 for reducing pressure the inside of the container 100 are disposed. These receiver tanks and the vacuum pump 171 and the container 100 are connectable through an air hose 157.

In a furnace 21, a molten aluminum is reserved. Here, one end 201*b* of a sucking pipe 201 is attached to the pipe 56 of the container 100, the other end 201*a* is inserted in the molten aluminum reserved in the furnace 21, and the sucking pipe 201 is fixed by use of a holding mechanism 202. In this state, the pressure inside of the container 100 is reduced by the vacuum pump 171, and thereby molten aluminum is introduced into the container 100.

Figure 6:
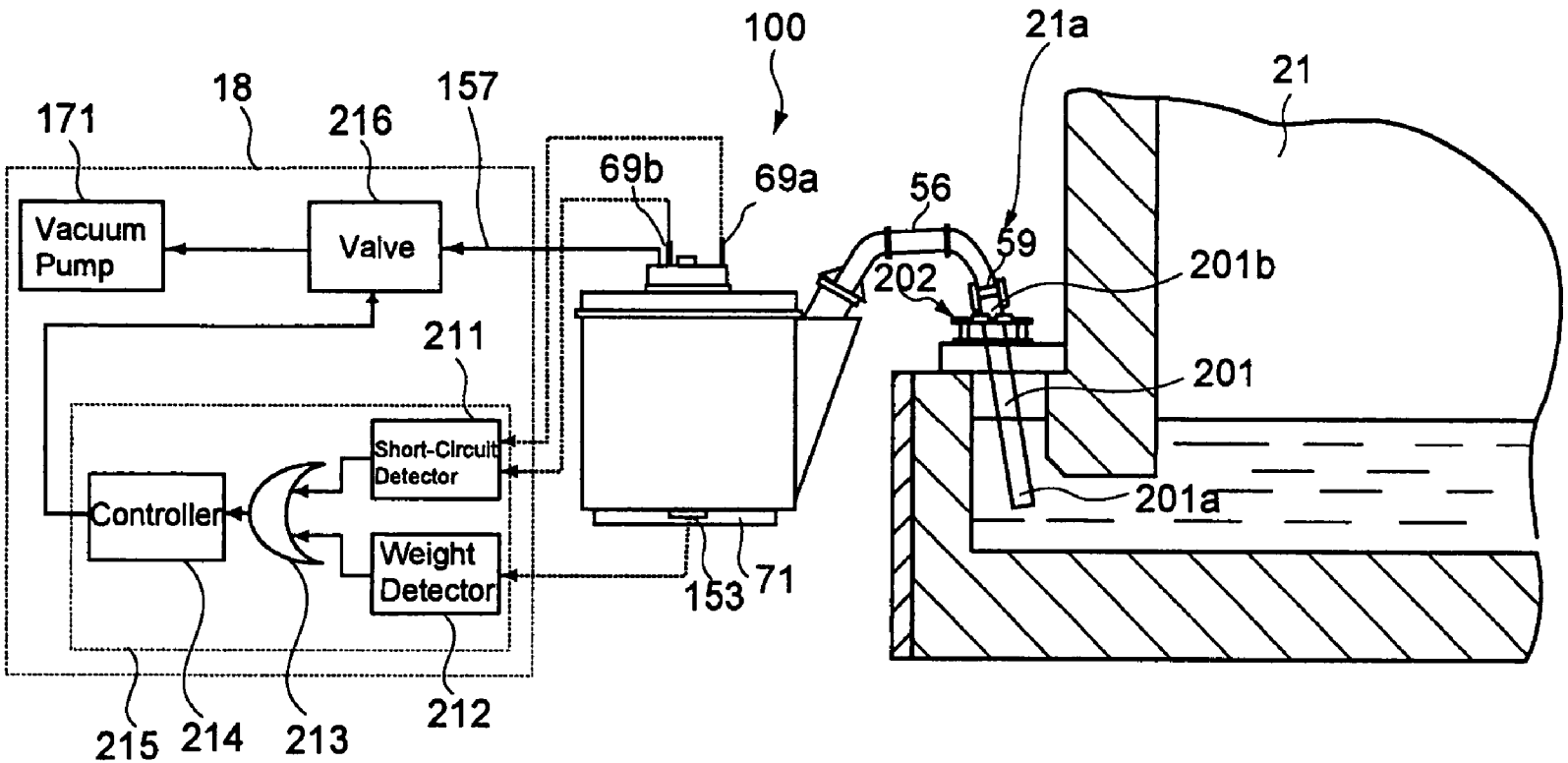
FIG. 6 is a diagram showing a configuration of a control unit of the molten metal introduction system shown in FIG. 5.

FIG. 6 is a diagram showing a configuration of a control unit of the molten metal introduction system.

A controller 210 comprises, a short-circuit detector 211 that detects the short circuit between the electrode 69*a* and the electrode 69*b*; a weight detector 212 that detects a weight at which the inside of the container 100 is assumed to be full of molten aluminum owing to a signal from the pressure sensor 153; an OR circuit 213 that takes a logical sum of the short circuit being detected by means of the short-circuit detector 211 and full weight being detected by use of the weight detector 212; and a valve on/off controller 214 that, in accordance with an output of the OR circuit 213, controls on/off of an on/off valve 216 that is inserted between the air-hose 157 and the vacuum pump 171.

When the vacuum pump 171 is operated and the on/off valve 216 is turned on, through the pipe 56 of the container 100, the molten aluminum is introduced into the container 100. When the container 100 becomes full of the molten aluminum, this is detected by means of the short-circuit detector 211 or the weight detector 212. The valve on/off controller 214, when at least one the short-circuit detector 211 and the weight detector 212 detects to be full, assumes to be full, and thereby the on/off valve 216 is turned off. Thereby, the introduction of the molten aluminum into the container 100 is stopped, followed by returning the inside of the container to atmospheric pressure.

In this embodiment, as mentioned above, two independent detection routes namely the short-circuit detection route and the weight detection routes are used to detect the fullness of the container 100; accordingly, the detection thereof can be assuredly carried out. However, in the present invention, the fullness detection like this may be carried out with the short-circuit detection route alone. Alternatively, it goes without saying that in addition to the short-circuit detection route, another detection system different from the weight detection route may be used.

Figure 7:
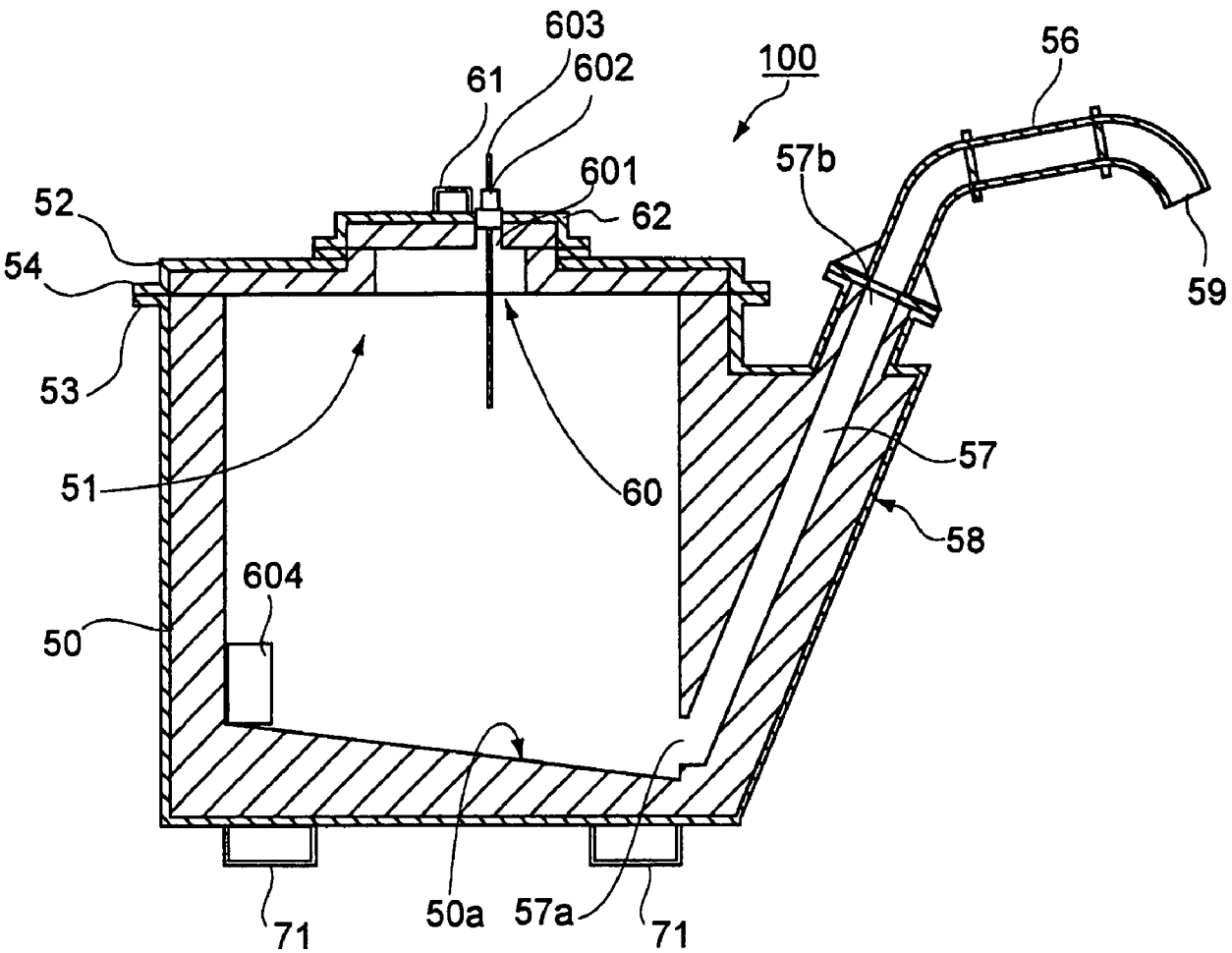
FIG. 7 is a diagram showing another example (first) of the molten metal supplying container of the present invention.

FIG. 7 is a diagram showing another example of the molten metal supplying container of the present invention;

In the container 100 involving the present embodiment, a hatch 62 is provided with only one passage 601 through which an electrode for detecting the fullness is inserted. In the passage 601, an electrode 603 is inserted through a socket 602 into the container 100. Furthermore, for instance, at a bottom portion inside of the container 100, a grounding electrode plate 604 is disposed. The electrode plate 604 is electrically connected to, for instance, the container 100 and thereby grounded. Thereby, the molten aluminum inside of the container 100 is grounded. Then, in this embodiment, when the short circuit is detected between the electrode 603 and the earth, the molten aluminum inside of the container 100 is detected to be full.

Furthermore, when the molten aluminum inside of the container 100 can be made a grounded state, the electrode plate 604 for disposition may positively be disposed as mentioned above.

Figure 8:
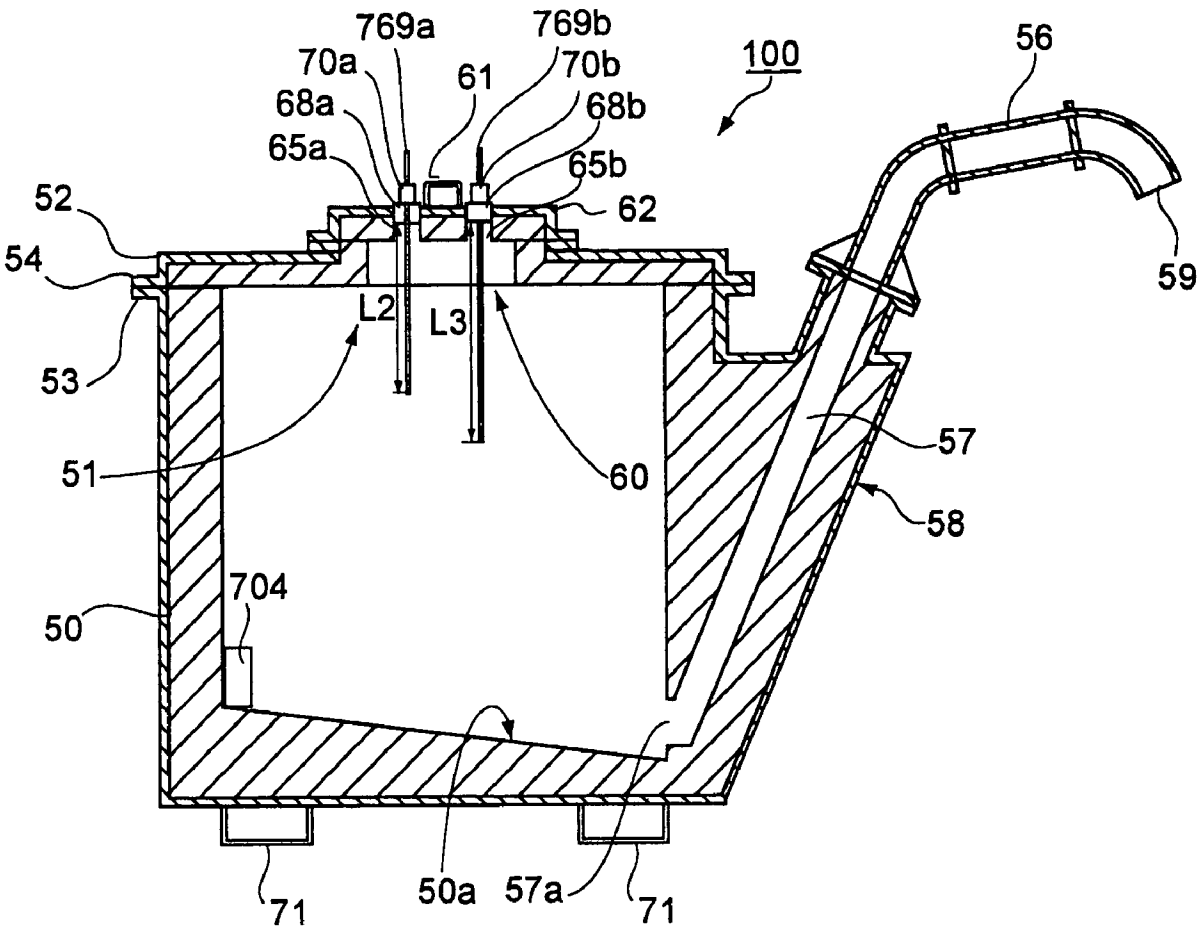
FIG. 8 is a diagram showing still another example (second) of the molten metal supplying container of the present invention.

FIG. 8 is a diagram showing another example of the molten metal supplying container of the present invention;

In the container 100 according to the present embodiment, lengths in the container 100 of two electrodes 769*a* and 769*b* are different from each other. For example, a length L2 in the container 100 of the electrode 769*a* is set shorter than a length L3 in the container 100 of the electrode 769*b*. Furthermore, for instance, at a bottom portion inside of the container 100, a grounding electrode plate 704 is disposed. Furthermore, when the molten aluminum inside of the container 100 can be made a grounded state, it is not necessary to provide the electrode plate 704 as described above.

Figure 9:
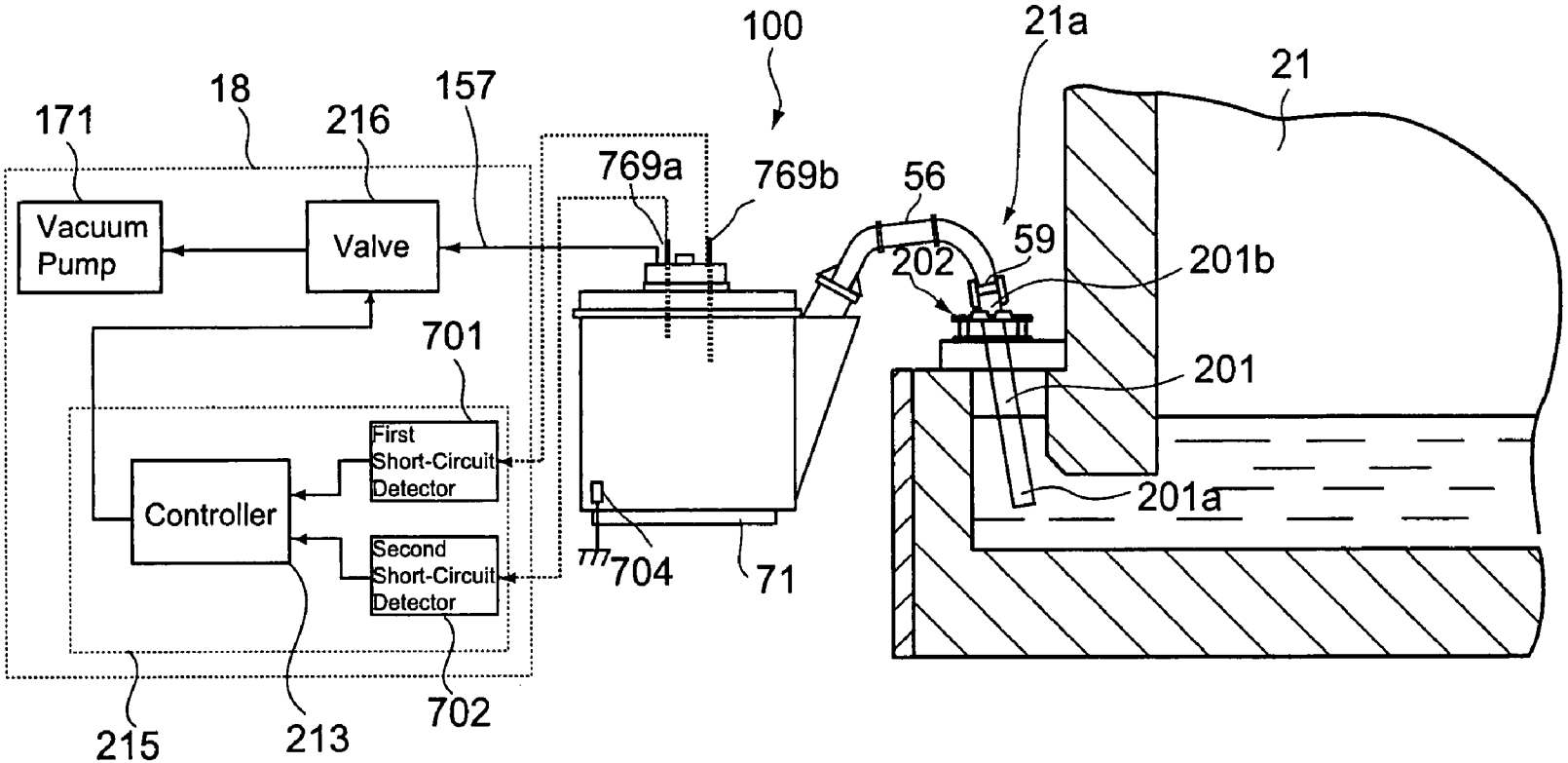
FIG. 9 is a diagram showing a configuration of a control unit that uses the molten metal supplying container shown in FIG. 8.

FIG. 9 is a diagram showing a configuration of a control system in the container 100 of this kind.

A first short-circuit detector 701 detects the short circuit between the electrode 769*a* and the ground. A second short-circuit detector 702 detects the short circuit between the electrode 769*b* and the ground. The first short-circuit detector 701 can detect a first liquid level of the molten aluminum in the container 100, and the second short-circuit detector 702 can detect a second liquid level that is lower than the first liquid level of the molten aluminum in the container 100.

Here, when the first liquid level is set at a position where the molten aluminum in the container 100 becomes full and the second liquid level is set at a position immediate before the fullness, for instance, the second short-circuit detector 702 can be used as means for notifying of a state immediate before the fullness.

When, for instance, a state immediate before the fullness is detected, the operation of reducing pressure is gradually using the vacuum pump is gradually slowed down and when the fullness is detected with the first short-circuit detector 701 the reducing pressure operation can be completely stopped. Accordingly, the inside of the container 100 can accurately be brought to the fullness.

Furthermore, for example, when the second short-circuit detector 702 detected a state immediate before the fullness and, even after a predetermined time passed, the first short-circuit detector 701 does not detect the fullness, the fullness may be assumed to be achieved and the operation of reducing pressure may be stopped. Thereby, the fullness can be detected more assuredly.

It goes without saying that in addition to the detection of the fullness through the short-circuit detection route like this, the detection of the fullness due to the weight detection route may be added under a logical sum condition and thereby to control. Thereby, the detection of the fullness can be carried out more precisely.

The first short-circuit detector 701 detects the short circuit between the first electrode and the ground. In addition to this, the short circuit between the first electrode and the second electrode may be detected. Alternatively, it goes without saying that the short circuit between the first electrode and the ground and the short circuit between the first electrode and the second electrode may be taken as a logical sum.

Figure 10:
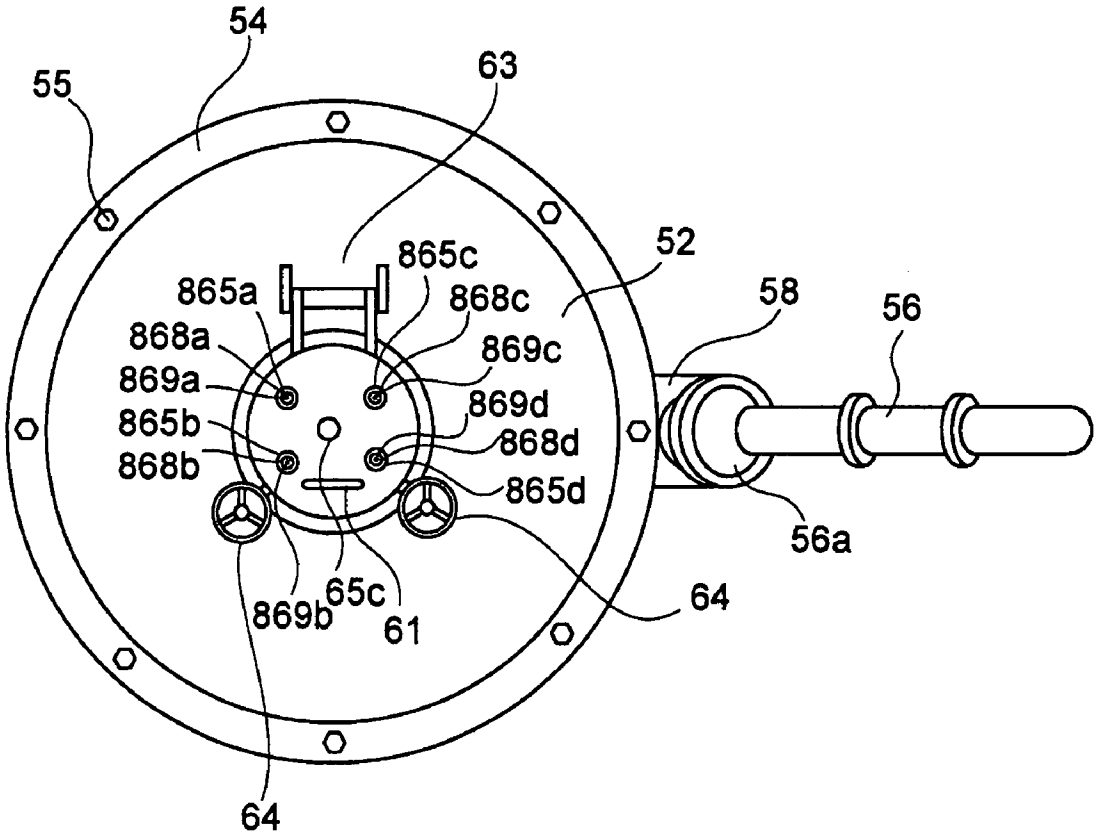
FIG. 10 is a plan view showing another example (third) of the molten metal supplying container of the present invention.
Figure 11:
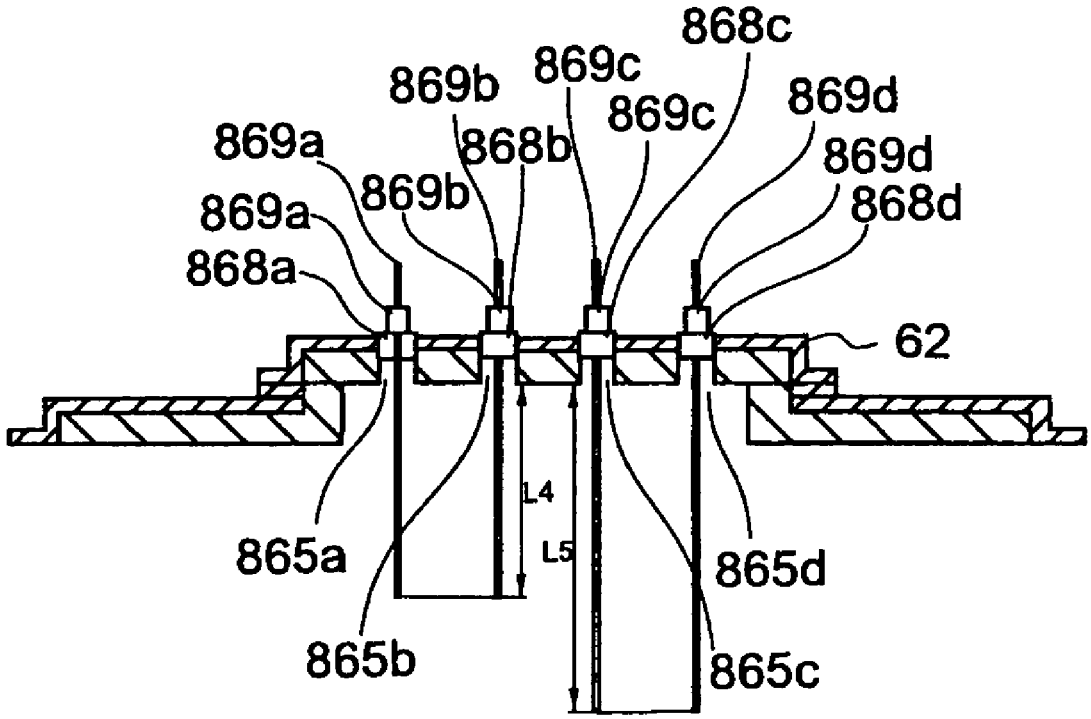
FIG. 11 is a partial sectional view of a molten metal supplying container shown in FIG. 10.

FIG. 10 is a diagram showing another example of the molten metal supplying container of the present invention;

To a hatch 62, four passages for use in electrode insertion, that is, a first, a second, a third and a fourth passages 865*a*, 865*b*, 865*c*, and 865*d*, are disposed. To each of the passages 865*a*, 865*b*, 865*c*, and 865*d*, plugs 868*a*, 868*b*, 868*c* and 868*d* that constitute one of a coupler, respectively, are attached.

To the first, the second, the third and the fourth passages 865*a*, 865*b*, 865*c* and 865*d*, the first, the second, the third and the fourth electrodes 869*a*, 869*b*, 869*c* and 869*d*, each of the electrode is inserted in a socket, are inserted, respectively. Lengths in the container 100 of the first electrode 869*a* and the second electrode 869*b* are the same, lengths in the container 100 of the third electrode 869*c* and the fourth electrode 869*d* are the same, and the length L4 in the container 100 of the first electrode 869*a* and the second electrode 869*b* are made shorter than the length L5 in the container 100 of the third electrode 869*c* and the fourth electrode 869*d*.

Figure 12:
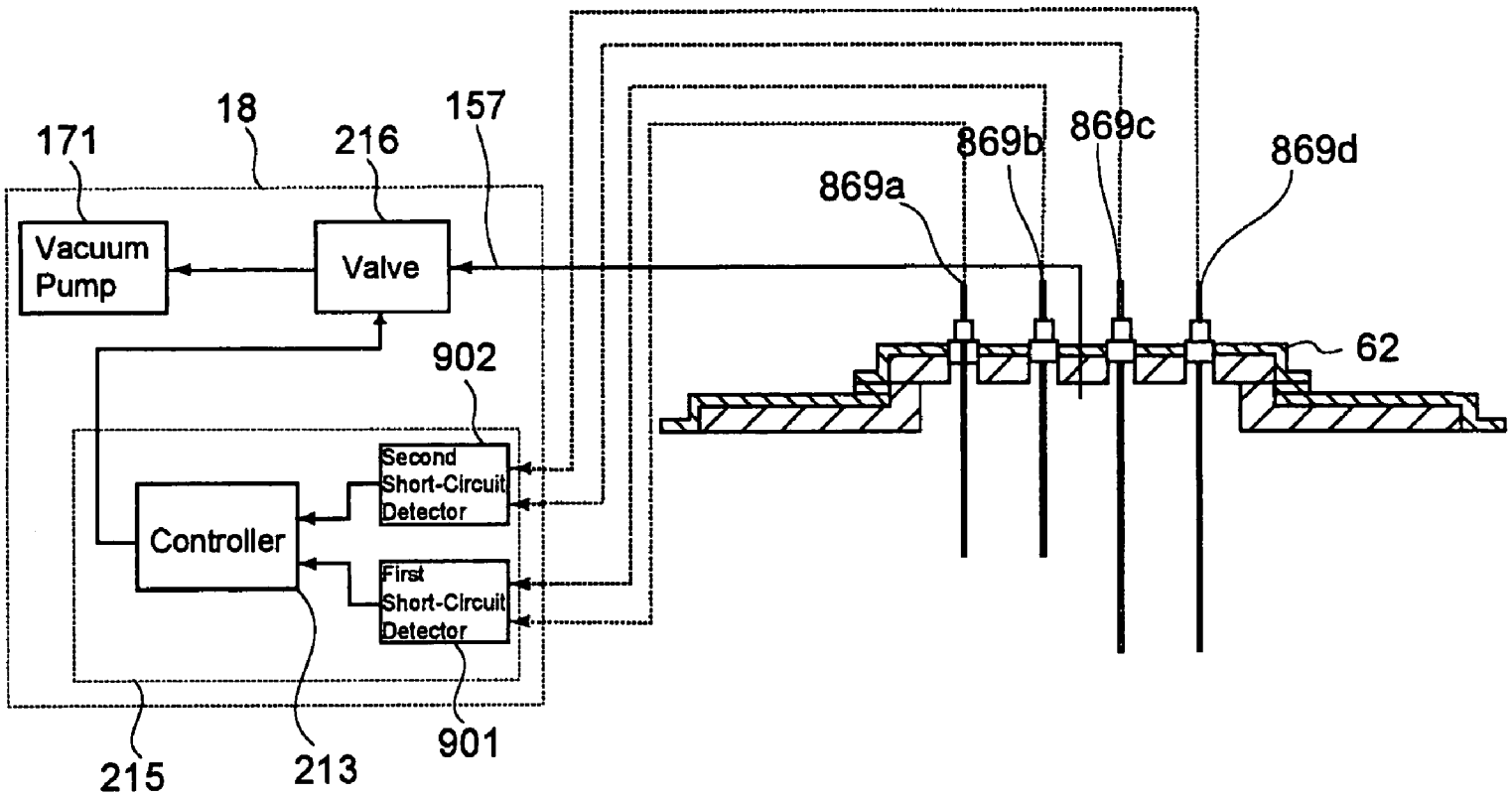
FIG. 12 is a diagram showing a configuration of a control unit using the molten metal supplying container shown in FIG. 10 and FIG. 11.

FIG. 12 is a diagram showing a structure of a pressure controlling apparatus.

A first short-circuit detector 901 detects the short circuit between the first electrode 869*a* and the second electrode 869*b*. Furthermore, a second short-circuit detector 902 detects the short circuit between the third electrode 869*c* and the fourth electrode 869*d*. The first short-circuit detector 901 can detect a first liquid level of the molten aluminum in the container 100, and the second short-circuit detector 902 can detect a second liquid level that is lower than the first liquid level of the molten aluminum in the container 100. Thereby, effects similar to the above embodiment can be obtained.

Next, another embodiment of the present invention will be described.

In the case of a molten metal being transported reserved in a container 100, it is necessary to close a passage 65*c* for increasing or reducing pressure inside of the container 100 and thereby to control inner pressure and passages 65*a* and 65*b* for being used in to insert electrodes. Furthermore, an opening portion of a supply pipe of the molten metal is also necessary to be treated similarly.

Figure 13:
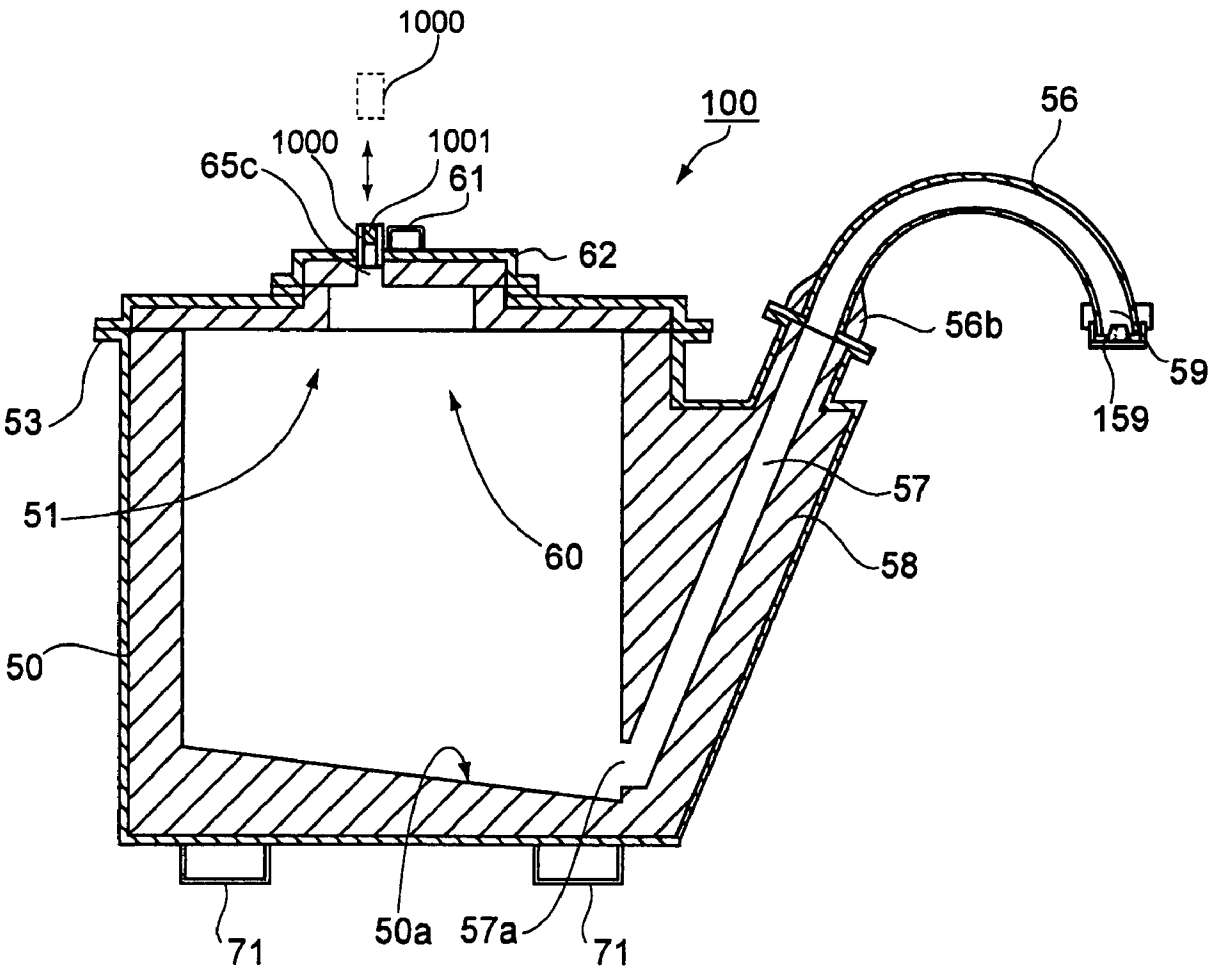
FIG. 13 is a diagram showing a cap relating to the present invention.

FIG. 13 shows an embodiment in this case.

As shown in FIG. 13, a cap 1000 that closes the passage 65*c* with a restriction member 1001. The cap 1000 is detachable to the passage 65*c*. The restriction member 1001 is a member selected or constituted so as to have the selectivity that allows, for example, air to go through but does not allow the molten aluminum to go through. As the restriction member, for instance, a steel sponge, a steel wool, a ceramic fiber, a molded product of sintered metal, porcelain and a member obtained by disposing an orifice to metal can be cited. Such a restriction member 1000 works as a safety device that allows air to go through and restricts molten metal to go through. Accordingly, the passage 65*c* can be clogged so as not to allow the molten metal to leak, and a situation in which the molten metal is unexpectedly discharged can be prevented from occurring. That is, even in the case of the inner pressure of the container being raised owing to expansion of a gas or vaporization of moisture, the pressure can be released outside of the container. Accordingly, situation such as pressurizing force being carelessly applied on the molten metal and thereby a high temperature molten metal leaking outside can be prevented. On the other hand, also from the passage 65*c* itself with the restriction member, the molten metal is prevented from leaking. This is because the restriction member such as the sintered metal or a molded body of ceramic fiber allows air to pass through but becomes sufficiently large a resistance to the molten metal such as molten aluminum alloy. In addition, when a cap 159 (having a restriction member similar to the cap 1000) according to the invention is similarly detachably attached to an outer opening 59 of the pipe 65, the outer opening 59 of the pipe 65 can be closed with the similar effect.

In addition, not only the passage 65*c* for use in pressure control but also the passages 65*a* and 65*b* for use in electrode insertion can be similarly closed with the cap 1000.

Figure 14:
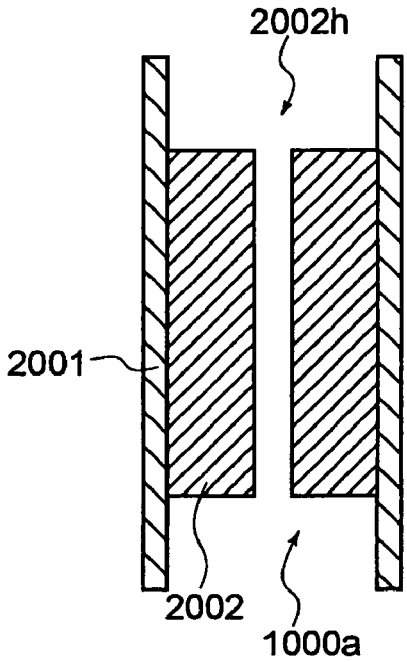
FIG. 14 is a sectional view of a cap relating to one embodiment of the present invention.
Figure 15:
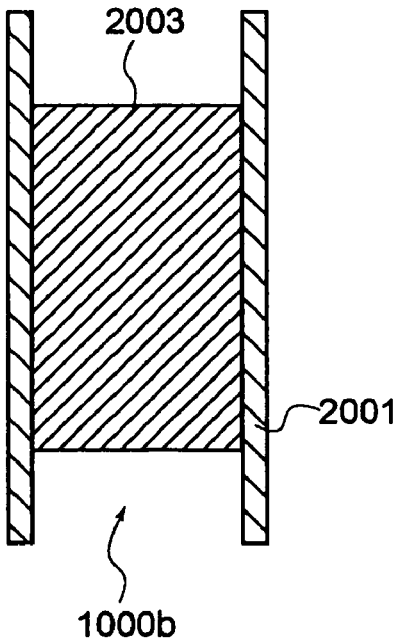
FIG. 15 is a sectional view of a cap involving another embodiment of the present invention.
Figure 19:
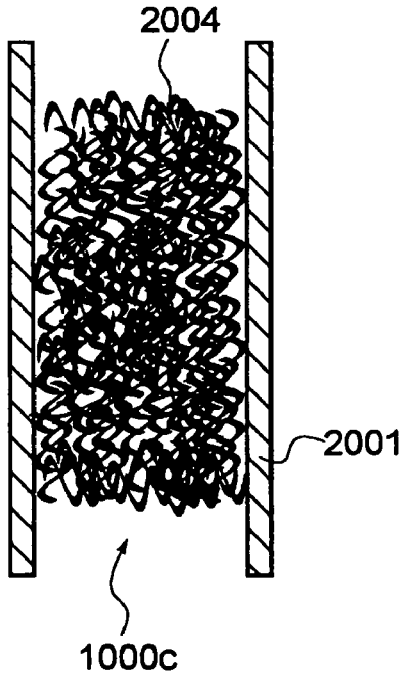
FIG. 19 is a diagram showing a configuration of a cap relating to yet another embodiment of the present invention.

FIGS. 14 and 15 are diagrams schematically showing examples of configuration of the safety device according to the invention. A cap 1000*a*, a safety device according to the present invention shown in FIG. 14, is one in which in a socket 2001 that constitutes a coupler, metal (such as iron, stainless steel, and brass) with an orifice 2002*h*, a restriction member is fitted. Furthermore, a cap 1000*b* shown in FIG. 15 is one in which in a similar socket 2001, a molded product of sintered metal 2003 is fitted. A cap 1000*c* shown in FIG. 19 is one in which a steel sponge 2004 is filled in a socket 2001. In this case, there is an advantage in that the restriction member can easily be exchanged. In addition, a plurality of the orifice 2002*h* may be formed. Other than this, members such as ceramics, porcelain, and steel wool having the heat resistance of substantially 750 degree centigrade or more and allow air to pass through may be adopted. The socket constitutes a coupler in combination with the plug disposed to the passage 65*c* of the hatch 62. In the example, an example where a restriction member is fitted in a socket has been explained. Anyway, a cap with a restriction member and a plug disposed to a passage 65*c* of a hatch 62 may be detachably connected through a socket. In this example, a coupler has a dimension of substantially 20 A to 40 A.

Furthermore, in the case of fine pores or an orifice, the molten metal, when passing through the pores, is deprived of heat to solidify, and solidified metal itself restricts a further flow of the molten metal. Accordingly, restriction member or the safety device of this kind is preferably larger in the heat capacity and a surface area. This is because when the molten metal passes through the safety device, the larger the heat capacity is, the faster the molten metal is cooled to solidify, and the larger the surface area is the more easily the heat content that the restriction member has received is externally dissipated. Thus, when a safety device according to the invention is disposed, the inner pressure of the container can be prevented from unexpectedly going up. Furthermore, since the molten metal inside can be prevented from unexpectedly leaking outside, the safety and the reliability of the container can be improved.

Figure 16:
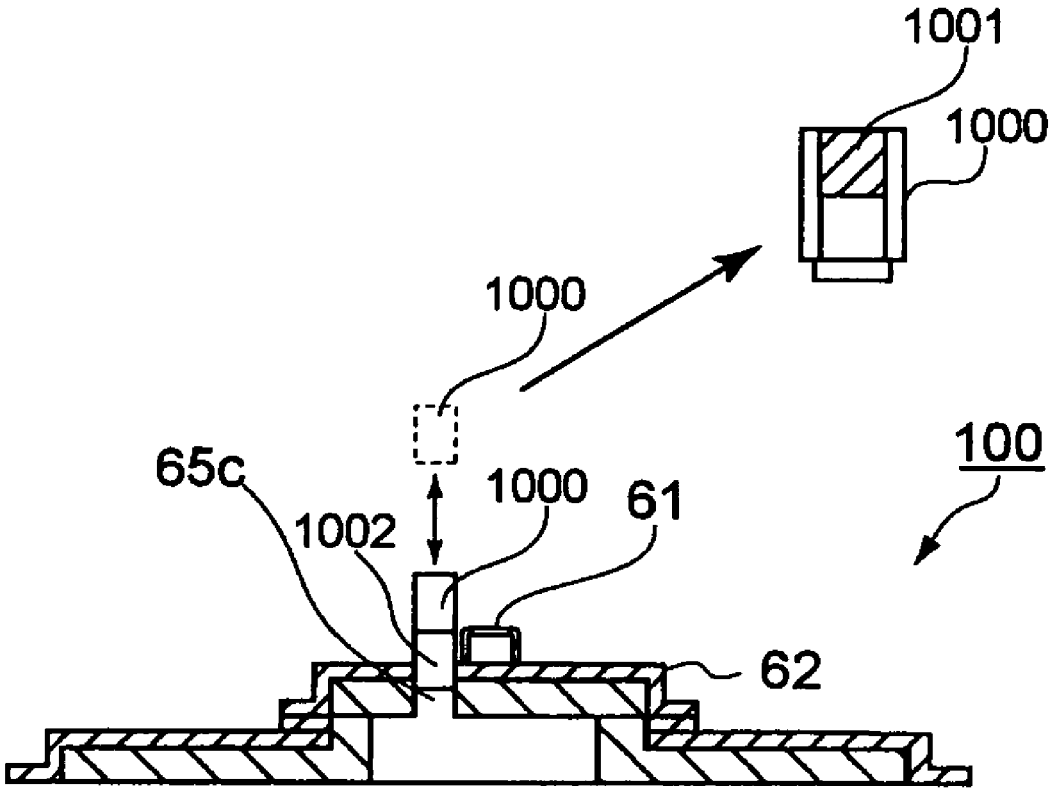
FIG. 16 is a diagram showing a configuration of a cap involving still another embodiment of the invention.

FIG. 16 is a diagram explaining another embodiment of the present invention.

As shown in FIG. 16, a plug 1002 that constitutes a coupler is attached to the passage 65*c*. To the plug 1002, a cap 1000 is detachably attached. The cap 1000 is made of a socket that constitutes the coupler and the restriction member 1001 is interposed therein. Owing to the interposition of the restriction member 1001, a second flow path 1003 that communicates with the passage 65*c* is closed. Thereby, the cap can be easily detached, resulting in an improvement in the workability. That is, thereby, the cap 1000 can be detached while preventing a situation where an operator comes into contact with a hot container 100 from occurring.

Figure 17:
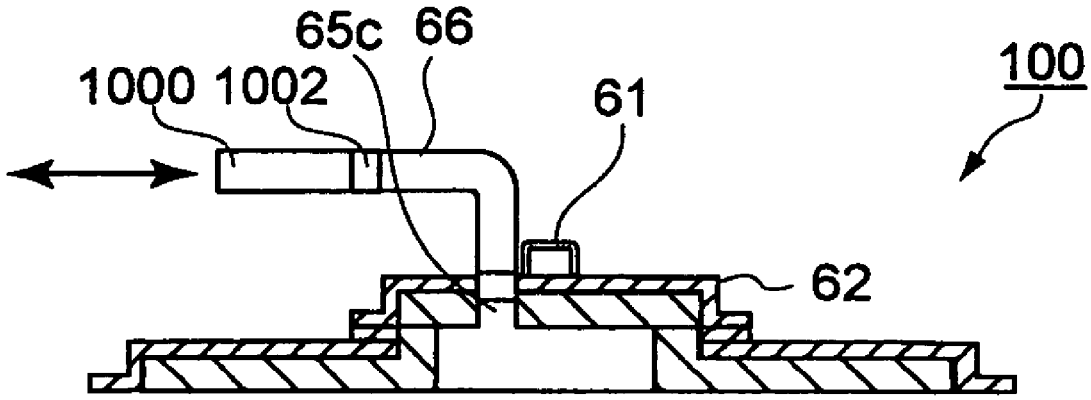
FIG. 17 is a diagram showing a configuration of a cap involving another embodiment of the invention.

FIG. 17 is a diagram explaining another embodiment of the present invention.

As shown in FIG. 17, in the embodiment, the above-mentioned plug 1002 is connected to a joint portion (horizontal top end portion) in a pipe 66 that is connected to the passage 65*c* disposed to a hatch of the container 100, and to the plug 1002, a cap 1000 is detachably attached.

Figure 18:
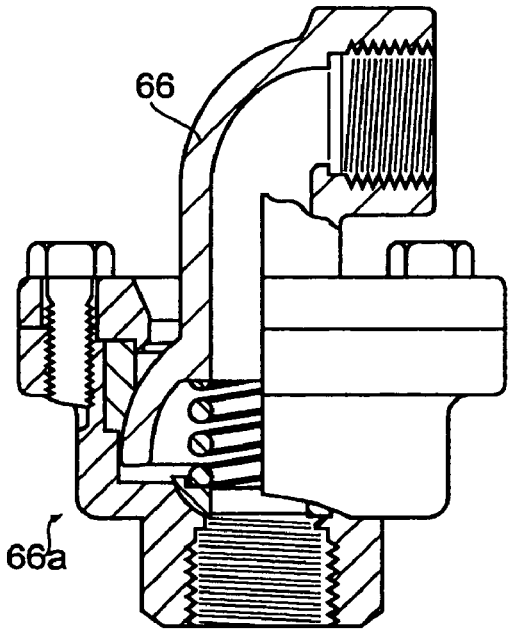
FIG. 18 is a diagram showing a configuration of a cap relating to still another embodiment of the present invention.

FIG. 18 is a diagram explaining another embodiment of the present invention.

As shown in FIG. 18, in order to make a pipe 66 connected to the passage 65*c* disposed to a hatch of the container 100 smoothly rotate in a horizontal direction, a flexible joint 66*a* that adopts a swivel joint is inserted in the pipe 66.

INDUSTRIAL AVAILABILITY

With such configuration of the present invention, "the container had become full" can be detected with certainty. According to the present invention, clogging of the pipe and/or the passage used for adjusting the inner pressure can be prevented. Furthermore, according to the present invention, the passage can be covered so that the molten metal does not leaks out and in the same time the case where the molten metal unexpectedly flowing out from the pipe can be prevented.

The invention claimed is:

1. A molten metal supplying container including a container having a passage communicating an inside and an outside of the container and applying a pressure to the inside of the container, the container being capable of storing a molten metal and allowing the molten metal to flow between the inside and the outside of the container owing to a pressure difference when the pressure is applied to the container by a pressurizing gas supply unit via an air hose having a first socket at an end portion of the air hose, comprising:

a first flow path, communicating the inside and the outside of the container, and allowing the molten metal to flow therein;

a first pipe disposed in the passage and having a plug at an end portion of the first pipe, the first pipe extending to an upper direction from an upper portion of the container, and bending at a predetermined height in a horizontal direction, and the plug extending in the horizontal direction, the plug being configured such that the first socket can be detachably connected to the plug, the plug and the first socket constituting a coupler structure;

a cap having a second pipe, a second socket, and a restricting member, the second pipe being filled with the restricting member and provided with the second socket at an end portion of the second pipe, the second socket being detachably connected, in a case where the first socket is detached from the plug, to the plug of the first pipe such that the second pipe connects to the first pipe, the plug and the second socket constituting the coupler structure, and the restricting member being configured to allow a gas to pass through the second pipe and restricting the molten metal to pass through the second pipe in a case where the container stores the molten metal and is transferred, the restricting member depriving the molten metal, when passing through the restricting member, of heat to solidify such that the solidified metal restricts a further flow of the molten metal.

2. The molten metal supplying container as set forth in claim 1, wherein the container has a container main body having a first opening at an upper portion, a lid disposed to cover the first opening of the container and having a second opening having a diameter smaller than the first opening, and a hatch openably disposed at the second opening and having the passage.

3. A safety device of a container capable of storing a molten metal and allowing the molten metal to flow between an inside and an outside of the container owing to a pressure difference when the pressure is applied to the container by a pressurizing gas supply unit via an air hose having a first socket at an end portion of the air hose, comprising:

a passage disposed at an upper portion of the container-and being capable of releasing an inner pressure of the container for applying a pressure to the inside of the container;

a first pipe disposed in the passage and having a plug at an end portion of the first pipe, the plug being configured such that the first socket can be detachably connected to the plug, the plug and the first socket constituting a coupler structure; and a cap having a second pipe, a second socket, and a restricting member, the second pipe being filled with the restricting member and provided with the second socket at an end portion of the second pipe, the second socket being detachably connected, in a case where the first socket is detached from the plug, to the plug of the first pipe such that the second pipe connects to the first pipe, the plug and the second socket constituting the coupler structure, and the restricting member being configured to allow a gas to pass through the second pipe and restricting the molten metal to pass through the second pipe in a case where the container stores the molten metal and is transferred, the restricting member depriving the molten metal, when passing through the restricting member, of heat to solidify such that the solidified metal restricts a further flow of the molten metal.

4. the safety device as set forth in claim 3, wherein the passage is configured to allow the molten metal inside the container to flow thereinto, and wherein the restricting member removes a heat from the molten metal to increase a viscosity of the molten metal when the molten metal inside the container flows into the passage.

5. A molten metal supplying container, including a container capable of storing a molten metal, and allowing the molten metal to flow between an inside and an outside of the container owing to a pressure difference when the pressure is applied to the container by a pressurizing gas supply unit via an air hose having a first socket at an end portion of the air hose, comprising:

a first flow path communicating the inside and the outside of the container, and allowing the molten metal to flow therein;

a pressure releasing pipe provided to an upper portion of the container and being capable of releasing an inner pressure of the container, for applying a pressure to the inside of the container;

a plug provided to an end portion of the pressure releasing pipe, the plug being configured such that the first socket can be detachably connected to the plug, the plug and the first socket constituting a coupler structure; and a cap having a pipe, a second socket, and a restricting member, the pipe being filled with the restricting member and provided the second socket with at an end portion of the pipe, the second socket being detachably connected, in a case where the first socket is detached from the plug, to the plug of the pressure releasing pipe such that the pipe connects to the pressure releasing pipe, the plug and the second socket constituting the coupler structure, and the restricting member being configured to allow a gas to pass through the pipe and restricting the molten metal to pass through the pipe in a case where the container stores the molten metal and is transferred, the restricting member depriving the molten metal, when passing through the restricting member, of heat to solidify such that the solidified metal restricts a further flow of the molten metal.

6. A safety cap of a container having a passage in which a first pipe having a plug at an end portion of the first pipe is disposed, at an upper portion, storing a molten metal, and being delivered from a first factory to a second factory, the passage being capable of releasing an inner pressure of the container and applying a pressure to an inside of the container via an air hose having a first socket at an end portion of the air hose detachably connected to the plug, the plug and the first socket constituting a coupler structure, comprising:

a second pipe filled with a restricting member;

a second socket provided to an end portion of the second pipe, the second socket being configured to be detachably connected, in a case where the first socket is detached from the plug, to the plug of the first pipe such that the second pipe connects to the first pipe, the plug and the second socket constituting the coupler structure; and a restricting member allowing a gas to pass through second the pipe and restricting the molten metal to pass through the second pipe, the restricting member depriving the molten metal, when passing through the restricting member, of heat to solidify such that the solidified metal restricts a further flow of the molten metal, wherein the second socket of the safety cap is detachably connected to the plug in a case where the container stores the molten metal and is transferred.

7. The safety cap as set forth in claim 6, wherein the restricting member allows air to pass therethrough and prevents molten aluminum to pass therethrough.

8. The safety cap as set forth in claim 6, wherein the restricting member is one selected from the group consisting of a member formed of a ceramic fiber, a molded product of sintered metal, porcelain, and a member obtained by disposing to a metal one of a passage and an orifice each having a small diameter.

* * * * *